US005297577A

United States Patent [19]

Yamanaka

[11] Patent Number: 5,297,577

[45] Date of Patent: Mar. 29, 1994

[54] CULVERT OF VACUUM SEWERAGE

[75] Inventor: Junichi Yamanaka, Tokoname, Japan

[73] Assignee: INAX Corporation, Aichi, Japan

[21] Appl. No.: 934,464

[22] PCT Filed: Feb. 10, 1992

[86] PCT No.: PCT/JP92/00127

§ 371 Date: Sep. 14, 1992

§ 102(e) Date: Sep. 14, 1992

[87] PCT Pub. No.: WO80/02855

PCT Pub. Date: Dec. 24, 1980

[30] Foreign Application Priority Data

| | | | |
|---|---|---|---|
| Feb. 14, 1991 | [JP] | Japan | 3-20951 |
| Dec. 11, 1991 | [JP] | Japan | 3-327567 |
| Dec. 11, 1991 | [JP] | Japan | 3-327568 |
| Dec. 11, 1991 | [JP] | Japan | 3-327569 |
| Dec. 11, 1991 | [JP] | Japan | 3-327570 |

[51] Int. Cl.[5] ..... E03F 3/00

[52] U.S. Cl. ..... 137/236.1; 137/205

[58] Field of Search ..... 137/205, 236.1

[56] References Cited

U.S. PATENT DOCUMENTS

| | | | |
|---|---|---|---|
| 2,903,010 | 9/1959 | Vienot et al. | 137/205 |
| 3,853,138 | 12/1974 | Amren | 137/205 X |
| 4,155,851 | 5/1979 | Michael | 137/236.1 X |
| 4,285,359 | 8/1981 | Doherty | 137/236.1 X |
| 4,333,487 | 6/1982 | Michael | 137/236.1 X |

FOREIGN PATENT DOCUMENTS

| | | |
|---|---|---|
| 169886 | 4/1906 | Fed. Rep. of Germany . |
| 2440672 | 3/1976 | Fed. Rep. of Germany . |
| 2838954 | 1/1980 | Fed. Rep. of Germany . |
| 56-46046 | 6/1981 | Japan . |
| 58-7042 | 1/1983 | Japan . |
| 80/02855 | 12/1980 | PCT Int'l Appl. . |
| 631774 | 8/1982 | Switzerland . |

*Primary Examiner*—Gerald A. Michalsky

*Attorney, Agent, or Firm*—Kanesaka and Takeuchi

[57] ABSTRACT

An inverted siphon culvert of a vacuum sewerage in which a reduction in vacuum caused by a head at the time of passing under an obstacle such as a river is prevented. An upstream vacuum sewer 2 provided at one side of a river 1 and a downstream vacuum sewer 3 provided at the other side are connected by a water flow pipe 4 and an air pipe 5 passing under the river 1. Sewage water in the upstream vacuum sewer 2 flows into the downstream vacuum sewer 3 through the water flow pipe 4. The vacuum transmitted from a vacuum station to the downstream vacuum sewer 3 is transmitted to the upstream vacuum sewer 2 through the air pipe 5 without being reduced substantially.

9 Claims, 18 Drawing Sheets

CULVERT OF VACUUM SEWERAGE

TECHNICAL FIELD

This invention relates to an inverted siphon culvert of a vacuum sewerage and, more particularly, to a vacuum sewerage arranged to prevent a reduction in vacuum by a head at an obstacle in a vacuum sewer line from a sewage generation source to a vacuum station to increase the range through which the sewage can be transported.

BACKGROUND ART

A vacuum sewage collection system is a system in which sewage water is collected by causing a vacuum in a sewer (referred to not as a complete vacuum but as a decompressed state) and by utilizing the pressure difference from atmospheric pressure.

FIG. 3 shows an example of the arrangement of this vacuum sewerage system.

Sewage water discharged from a home or factory sanitary facilities flows into a vacuum valve unit (relay unit) 32 through an inflow pipe 31. The sewage water is then led from this vacuum valve unit 32 to a vacuum station 34 through a vacuum sewer 33 and is thereafter led to a sewage treatment system through a pressure feed pump 35 and a pressure feed pipe 36.

In this vacuum station 34, sewage water in a receiving tank 38 is fed to an ejector 39 by sewage circulation pump 37. The vacuum sewer 33 is thereby evacuated so that sewage water is collected in the vacuum station 34.

The vacuum valve unit 32 serves for relaying between the sewage source and the vacuum station 34, and has a tank 40 into which sewage water from the inlet pipe 31 flows, a suction pipe 41 for drawing sewage water in the tank 40 and supplying the drawn sewage water to the vacuum sewer 33, a vacuum valve 42 provided in the suction pipe 41, a controller 43 for operating the vacuum valve 42, and so on. For the vacuum valve 42, a negative pressure in the vacuum sewer 33 is used as a driving power source. In the illustration, an air pipe is indicated at 44, an inspection hole is indicated at 45, an air pipe is indicated at 46, and lifts are indicated at 50. Ordinarily, a plurality of vacuum valve units are connected to a vacuum sewer.

Such a vacuum sewage collection system does not require, in laying a pipe line, a continuous gradient such as that in a natural downflow type sewerage and has the following advantages.

(1) Since the pipe line laying depth is small, the sewer construction cost can be reduced remarkably.

(2) It enables sewerage construction in an area where laying of sewers is difficult because of a high underground water level or difficulty in excavation due to the existence of a base rock or for other reasons.

(3) Construction under a winding lane or the like is easy.

(4) Because of forced intermittent high-speed collection of a gas-liquid mixture using a vacuum, the system is free of clogging in pipe lines and piping using small-diameter pipes is possible.

In a vacuum sewage collection system, the transportable range (sewage collection basin) is a range in which the degree of vacuum at ends of vacuum sewers is maintained at a negative pressure of 1,000 to 2,500 mmAq. Accordingly, in the case of a system having no factor of reducing the degree of vacuum in vacuum sewage pipe lines, the transportable range can be obtained as a value proportional to the value which is obtained by subtracting the necessary negative pressure of 1,000 to 2,500 mmAq at the end from the degree of vacuum $H_0$ generated in the vacuum station.

If there is a rising gradient in a vacuum sewage pipe line in such a vacuum sewage collection system, the head at the rising gradient consumes the vacuum generated in the vacuum station to cause a reduction in the degree of vacuum, resulting in a reduction in the transportable range. For example, if, in a ground configuration where there is an obstacle (e.g., a river), a vacuum sewer 33 is embedded so as to pass under or over the obstacle, i.e., a river or the like, as shown in FIG. 4 or 5, the head between A and B is $H_1$ or $H_2$. By this head $H_1$ or $H_2$, the degree of vacuum $H_0$ of the vacuum station is correspondingly reduced ($H_0-(H_1$ or $H_2)$). The transportable range in this case is proportional to a value obtained by subtracting the above-mentioned necessary negative pressure 1,000 to 2,500 mmAq at the end from ($H_0-(H_1$ or $H_2)$). Thus, the transportable range in this case is much smaller than the transportable range in the case of a flat ground configuration.

For this reason, the development of a technique is expected which enables, in a case where an obstacle is formed in a vacuum sewage pipe line between a sewage generation source and a vacuum station, prevention of a reduction in the degree of vacuum due to a head of the obstacle to extend the sewage transportable range.

DISCLOSURE OF THE INVENTION

The present invention has been achieved in consideration of the above-described circumstances of the conventional art, and an object of the present invention is to provide a vacuum sewerage in which a reduction in the degree of vacuum due to a head of an obstacle can be prevented.

Another object of the present invention is to provide an inverted siphon culvert of a vacuum sewerage in which accumulation of solid matters in a water flow pipe can be prevented. Hereinafter, the inverted siphon culvert is called merely a "siphon culvert". Yet another object of the present invention is to provide a siphon culvert of a vacuum sewerage applicable even in a case where a downstream vacuum sewer is slightly higher in level than an upstream vacuum sewer.

Still another object of the present invention is to provide a siphon culvert of a vacuum sewerage in which an extraneous matter in a water flow pipe can be discharged easily and efficiently by an air blow.

A siphon culvert of a vacuum sewerage in a first form of the present invention has an upstream vacuum sewer provided at one side of an obstacle and a downstream vacuum sewer provided at the other side of the obstacle, the upstream and downstream vacuum sewers being connected to each other. This siphon culvert is characterized by comprising a water flow pipe passing under the obstacle to connect the upstream vacuum sewer and the downstream vacuum sewer, and an air pipe passing along one of upper and lower sides of the obstacle to connect the upstream vacuum sewer and the downstream vacuum sewer.

A siphon culvert of a vacuum sewerage in a second form is characterized in that a gas-liquid separation means is further provided in the upstream vacuum sewer of the vacuum sewerage siphon culvert in the first form.

A siphon culvert of a vacuum sewerage in a third form is characterized in that, in the vacuum sewerage siphon culvert in the first form, at least a lower portion of a section of the water flow pipe having a rising gradient in the downstream direction has a sectional path area smaller than that of the upstream vacuum sewer.

A siphon culvert of a vacuum sewerage in a fourth form is characterized in that, in the vacuum sewerage siphon culvert in the first form, a downstream end of the air pipe is connected to a portion of the water flow pipe in the vicinity of the downstream vacuum sewer.

A siphon culvert of a vacuum sewerage in a fifth form is characterized by further providing, in the vacuum sewerage siphon culvert in the first form, a pipe path for enabling a lowermost-level portion of the water flow pipe or a portion in the vicinity of the lowermost-level portion to communicate with the atmospheric air, and flow path selection means for selectively establishing a first state in which the pipe path is opened to the atmospheric air and in which direct air flow from the air pipe into the downstream vacuum sewer is inhibited and a second state in which the pipe path is closed and in which direct air flow from the air pipe into the downstream vacuum sewer is allowed.

A siphon culvert of a vacuum sewerage in a sixth form is characterized by further providing, in the vacuum sewerage siphon culvert in the first form, a first pipe path for enabling a lowermost-level portion of the water flow pipe or a portion in the vicinity of the lowermost-level portion to communicate with the atmospheric air, a second pipe path for enabling an intermediate portion of a section of the water flow pipe having a rising gradient in the downstream direction to communicate with the atmospheric air, and flow path selection means for selectively establishing a first state in which the first pipe path is opened to the atmospheric air while the second pipe path is closed and in which direct air flow from the air pipe into the downstream vacuum sewer is inhibited, a second state in which the first and second pipe paths are closed and in which direct air flow from the air pipe into the downstream vacuum sewer is allowed, and a third state in which the first pipe path is closed while the second pipe path is opened to the atmospheric air and in which direct air flow from the air pipe into the downstream vacuum sewer is inhibited.

A siphon culvert of a vacuum sewerage in a seventh form is characterized in that, in the vacuum sewerage siphon culvert in the first form, a valve for opening and closing the air pipe is provided in the air pipe, and a means for introducing the atmospheric air to at least one of the air pipe and the upstream vacuum sewer is provided on the upstream side of the valve.

In the vacuum sewerage siphon culvert in the first form, sewage water in the upstream vacuum sewer is fed under the obstacle through the water flow pipe to the downstream vacuum sewer at a level lower than that of the upstream vacuum sewer, and a negative pressure generated in a vacuum station is ordinarily transmitted to the interior of the vacuum sewers by the air pipe connecting the downstream and upstream vacuum sewers. Therefore, the negative pressure generated by the vacuum station is not consumed by a head in the vacuum sewer with respect to passage under the obstacle, and it can be used effectively for heads in other places.

In the vacuum sewerage siphon culvert in the second form, the gas-liquid separation means is provided in the upstream vacuum sewer to positively separate the fluid flowing through the upstream vacuum sewer into a gas and a liquid.

Accordingly, only water flows through the water flow pipe while only air flows through the air pipe, thereby enabling sewage water to be smoothly transported.

In the vacuum sewerage siphon culvert in the third form, the sectional path area of at least a lower portion of a section of the water flow pipe having a rising gradient in the downstream direction, i.e., a portion where solid matters can deposite most easilty is set to a value smaller than the sectional path area of the upstream vacuum sewer.

In this portion, therefore, the flow velocity of sewage water flowing through the water flow pipe is increased in comparison with other portions. Consequently, an upward flow having a high flow velocity and a large force for lifting extraneous matters can be obtained in the rising-gradient portion. Solid matters can be efficiently discharged to the downstream vacuum sewer by the sewage water flow increased in velocity in this manner.

In the vacuum sewerage siphon culvert in the fourth form, a downstream end of the air pipe is connected to a portion of the water flow pipe in the vicinity of the downstream vacuum sewer. The negative pressure transmitted through the air pipe therefore has a sewage water air lift effect in the section of the air pipe from the above-mentioned air pipe connection position to the downstream vacuum sewer. By this air lift effect, sewage water is pumped up to the downstream vacuum sewer.

Accordingly, there is no need to lay the downstream vacuum sewer always at a level lower than that of the upstream vacuum sewer by a height $H_4$, and the degree of design freedom can be increased.

By this air lift effect, the degree of vacuum of the vacuum station is slightly consumed, but the consumption rate is not so high as to hinder the water flow.

In the vacuum sewerage siphon culvert in the fifth form, by closing the pipe path for enabling the lowermost-level portion of the water flow pipe or a portion in the vicinity of the lowermost-level portion to communicate with the atmospheric air and by causing a direct air flow from the air pipe into the downstream vacuum sewer, sewage water in the upstream vacuum sewer can be supplied to the downstream vacuum sewer through the water flow pipe in the same manner as the vacuum sewerage siphon culvert of the prior appication, and the vacuum transmitted from the vacuum station to the downstream vacuum sewer can be transmitted to the upstream vacuum sewer without being reduced substantially.

On the other hand, by opening this pipe path to the atmospheric air while inhibiting a direct air flow from the air pipe to the downstream vacuum sewer, with decompression from the vacuum station, air is supplied from this pipe path to the lowermost-level portion of the water flow pipe or a portion of this pipe in the vicinity of the lowermost-level portion where extraneous matters can deposit most easily. By this air, deposits which have deposited and accumulated in this portion are directly blown and loosened effectively to be easily discharged to the downstream vacuum sewer.

In the vacuum sewerage siphon culvert in the sixth form, by closing the first pipe path for enabling the lowermost-level portion of the water flow pipe or a portion in the vicinity of the lowermost-level portion to communicate with the atmospheric air and the second pipe path for enabling an intermediate portion of the section of the water flow pipe having a rising gradient in the downstream direction to communicate with the atmospheric air and by causing a direct air flow from the air pipe into the downstream vacuum sewer, sewage water in the upstream vacuum sewer can be supplied to the downstream vacuum sewer through the water flow pipe in the same manner as the vacuum sewerage siphon culvert of the prior appication, and the vacuum transmitted from the vacuum station to the downstream vacuum sewer can be transmitted to the upstream vacuum sewer without being reduced substantially.

In the siphon culvert in the sixth form as well, by opening the first pipe path to the atmospheric air while closing the second pipe path and by inhibiting a direct air flow from the air pipe to the downstream vacuum sewer, deposits in the water flow pipe can be loosened effectively to be easily discharged to the downstream vacuum sewer as in the case of the vacuum sewerage siphon culvert in accordance with the first form. However, before this air blowing, a state may be established in which the first pipe path is closed, the second pipe path is opened to the atmospheric air and a direct air flow from the air pipe to the downstream vacuum sewer is inhibited, thereby achieving a reduction in the degree of decompression necessary for starting the air blowing.

BEST MODE FOR CARRYING OUT THE INVENTION

Embodiments of the present invention will be described below in detail with reference to the drawings.

FIGS. 1 to 17 are cross-sectional views each showing an embodiment of a siphon culvert of a vacuum sewerage of the present invention.

Figure 1:
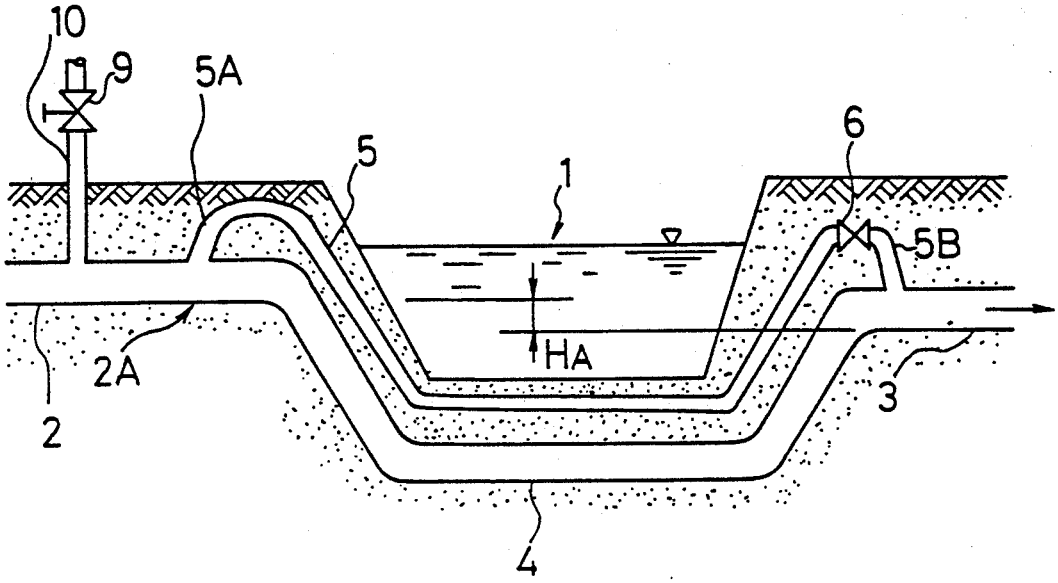
FIG. 1 is a cross-sectional view of an embodiment of the vacuum sewerage in the first form.

Referring to FIG. 1, a vacuum sewerage is provided in such a manner as to extend across an obstacle (a river in this embodiment) 1. A sewer 2 is an upstream vacuum sewer, and a sewer 3 is a downstream vacuum sewer. A water flow pipe 4 is installed so as to pass under the river 1 to connect the vacuum sewers 2 and 3 so that water can flow therethrough. The upstream vacuum sewer 2 is disposed at a level higher than that of the downstream vacuum sewer 3 by $H_A$ which corresponds to a small head necessary for enabling sewage water to flow through the water flow pipe 4 from the upstream vacuum sewer 2 to the downstream vacuum sewer 3. The downstream end of the downstream vacuum sewer 3 is connected to a vacuum station (not shown) to enable decompression in the downstream vacuum sewer 3. An air pipe 5 which passes under the river 1 provides a communication between the downstream vacuum sewer 3 and the upstream vacuum sewer 2 to also enable decompression in the upstream vacuum sewer 2. In this embodiment, a valve 6 is provided in this air pipe 5, and a valve 9 is provided in an atmosphere communication pipe 10 rising from the upstream vacuum sewer 2.

To prevent water from entering the air pipe 5, an rising-gradient portion 5A is provided as a portion of the air pipe 5 in the vicinity of a portion 2A branching from the upstream vacuum sewer 2. Similarly, a rising portion 5B is provided as a portion of the air pipe 5 in the vicinity of a portion connected to the downstream vacuum sewer 2. Instead of this rising portion 5B, a check valve may be provided which allows air flow from the air pipe 5 into the downstream vacuum sewer 3 while checking water flow from the downstream vacuum sewer 3 into the air pipe 5.

Preferably, the water flow pipe 4 of this embodiment is installed so as to have a falling gradient in the downstream direction.

Figure 17:
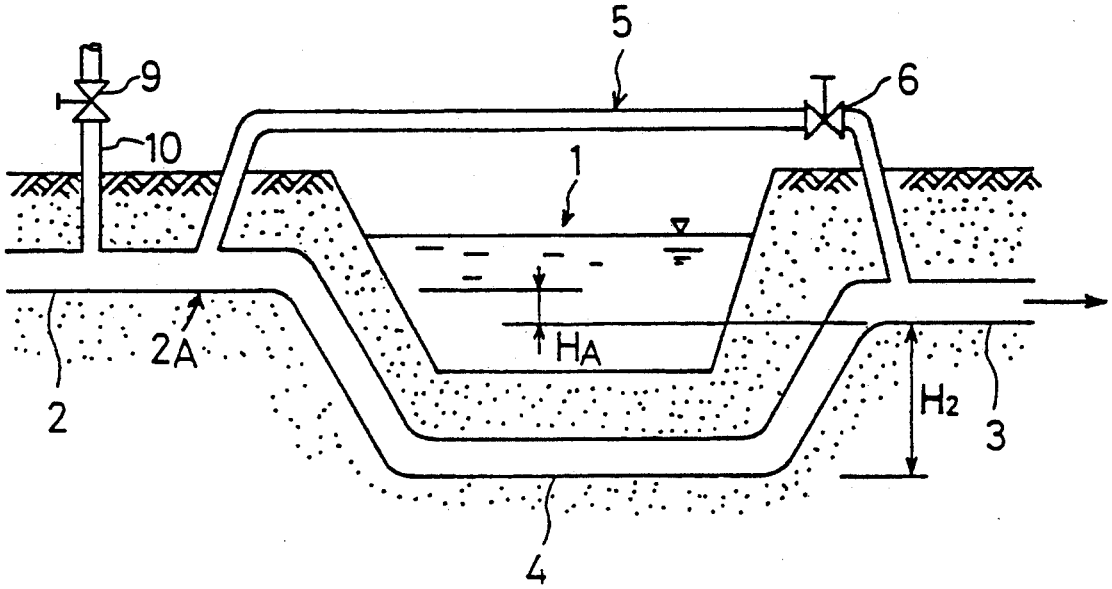
FIG. 17 is a cross-sectional view of an embodiment of the vacuum sewerage in the first form.

In the embodiment of FIG. 17, the air pipe 5 is laid so as to pass over the river 1. The construction thereof is the same as that of FIG. 1 in other respects.

In the thus-constructed vacuum sewerage siphon culverts of FIGS. 1 and 17, during ordinary operation, the valve 6 is open while the valve 9 is closed. Sewage water which has flowed through the upstream vacuum sewer 2 passes through the water flow pipe 4, reaches the downstream vacuum sewer 3 and flows further downstream through the downstream vacuum sewer 3. On the other hand, the vacuum in the downstream vacuum sewer 3 is transmitted to the upstream vacuum sewer 2 through the air pipe 5 to effect air lifting with respect to a head (not shown) provided in the upstream vacuum sewer 2.

Thus, in this vacuum sewerage siphon culvert, sewage water passes under an obstacle such as river 1 by flowing through the water flow pipe 4. Therefore, there is no need for a head for passing under the obstacle, and the loss head is very small. The negative pressure generated in the vacuum station can therefore be used for heads in places other than the place of the obstacle. Consequently, the collectable basin area of one vacuum station can be remarkably extended and also the degree of design freedom can be greatly increased.

Deposits are accumulated in the water flow pipe 4 as sewage water flows. The accumulated deposits can be discharged as described below. That is, in the night time or in a holiday or the like when the amount of downflow water is small, the valve 6 is closed and the valve 9 of the upstream vacuum sewer is then opened to draw air into the upstream vacuum sewer 2 and to reduce the pressure in the downstream vacuum sewer 3 by the vacuum station. Air blowing is thereby effected in the water flow pipe 4, so that the deposits are discharged to the downstream vacuum sewer 3. Instead of air blowing, pressure-introduction using an air pump or the like may be performed.

Figure 2:
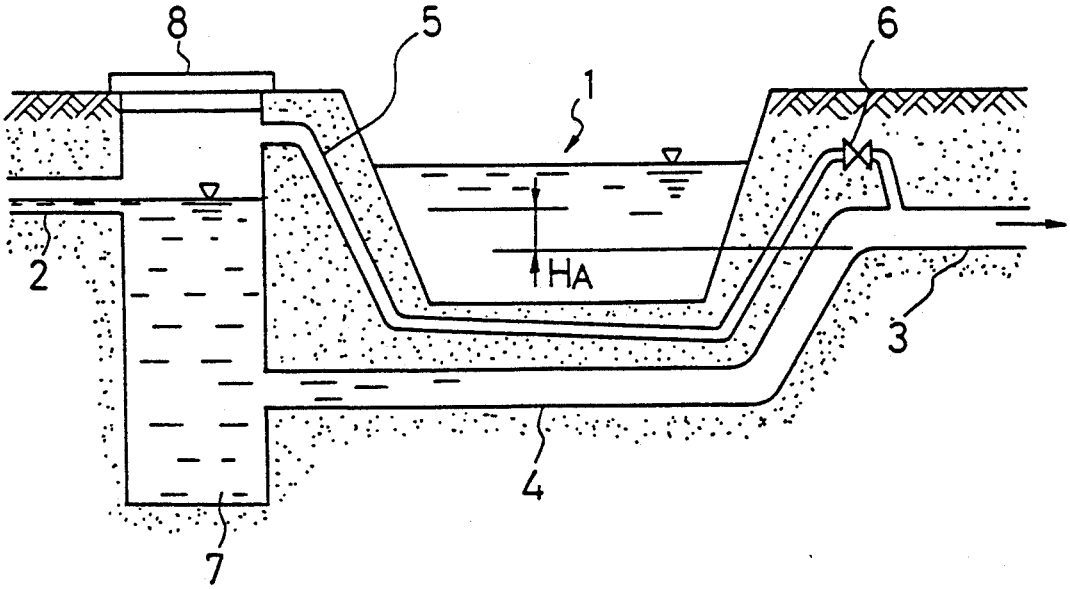
FIG. 2 is a cross-sectional view of another embodiment of the vacuum sewerage in the second form.
Figure 3:
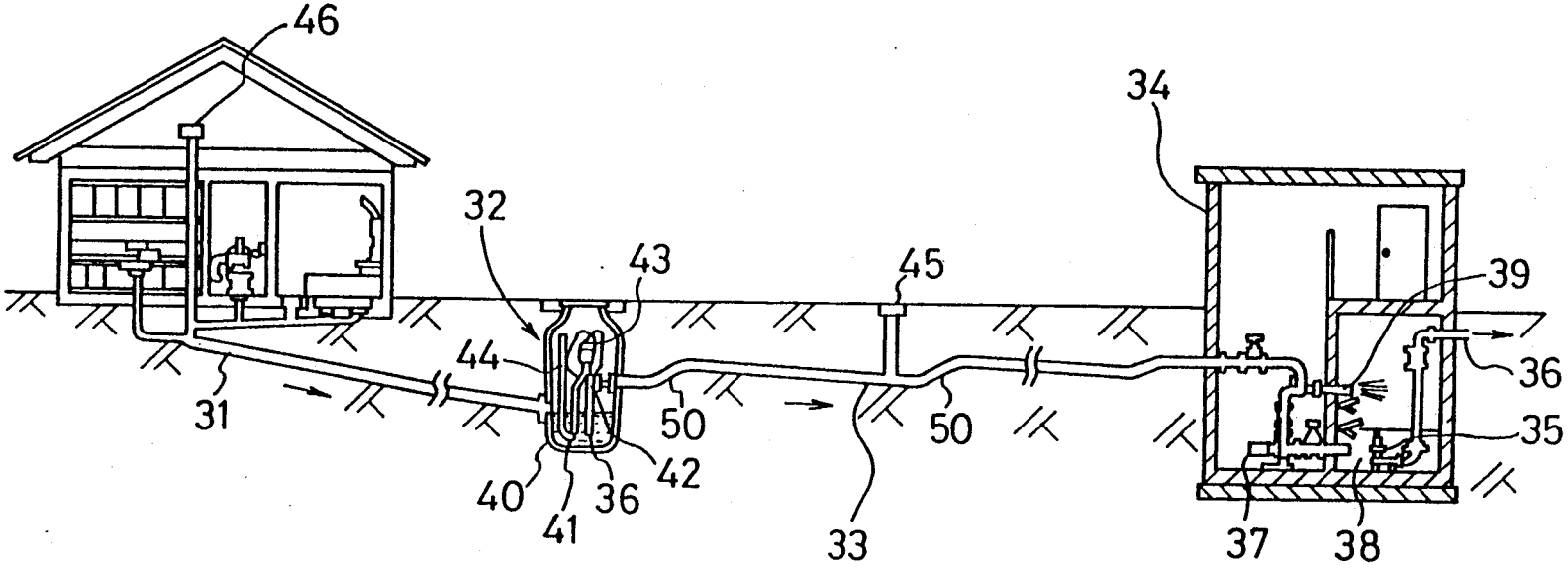
FIG. 3 is a cross-sectional view of a vacuum sewage water collection system.
Figure 4:
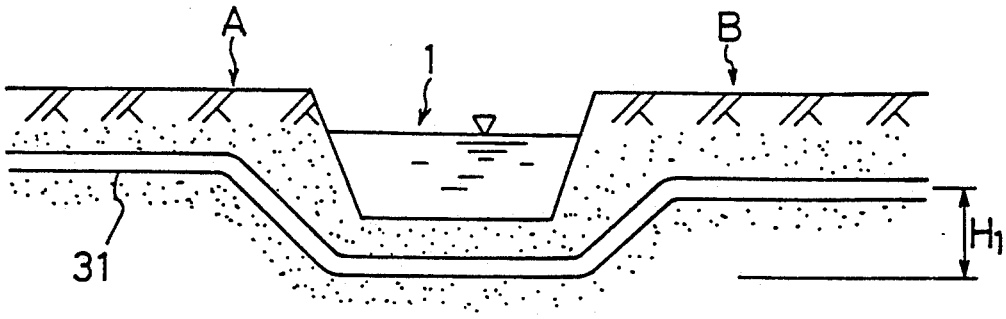
FIG. 4 Prior Art
FIG. 4 is a cross-sectional view of a conventional vacuum sewerage siphon culvert.
Figure 5:
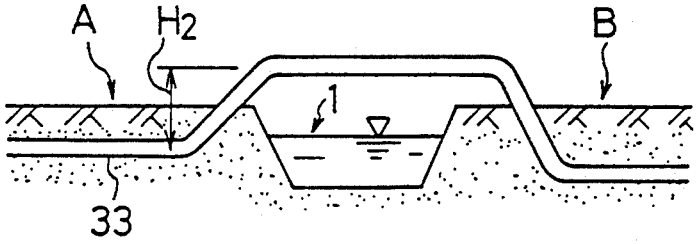
FIG. 5 Prior Art
FIG. 5 is a cross-sectional view of a conventional vacuum sewerage siphon culvert.
Figure 18:
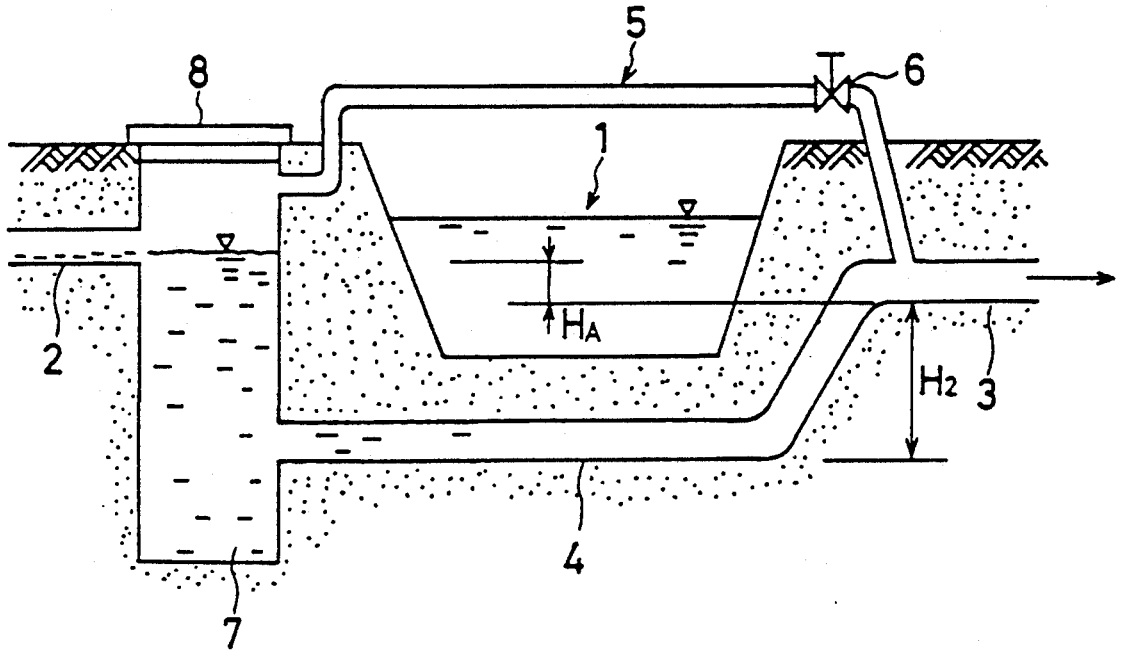
FIG. 18 is a cross-sectional view of another embodiment of the vacuum sewerage in the second form.

FIGS. 2 and 18 show embodiments in the second form. In the embodiment of FIG. 2, a pit 7 such as a manhole to which an upstream vacuum sewer 2 is connected is installed in the vicinity of an obstacle such as a river 1, and a water flow pipe 4 is connected to a lower portion of the pit 7 (higher than the bottom). An air pipe 5 is also connected to the pit 7 (or to the upstream vacuum sewer 2). The pit 7 is closed with a cover 8 in an air-tight manner such as to prevent the atmospheric air from leaking into the pit 7.

In the embodiment of FIG. 18, the air pipe 5 is laid so as to pass over the river 1. The construction of this embodiment is the same as that of FIG. 2 in other respects.

In the vacuum sewerage siphon culverts of FIGS. 2 and 18, sewage water can be sent from the upstream vacuum sewer 2 to the downstream vacuum sewer 3 with a very small loss head and deposits can be blown out if necessary, as in the case of the embodiment of FIG. 1.

In the embodiments of FIGS. 2 and 18, sewage water flowing into the pit 7 can be processed for gas-liquid separation. Therefore, only water is caused to flow through the water flow pipe 4, so that sewage water can pass smoothly through the water flow pipe 4.

That is, if in the vacuum sewerage siphon culvert shown in FIG. 1, the degree of separation of a gas and a liquid (air and sewage water) at the portion 2A where the air pipe 5 branches from the upstream vacuum sewer 2 is insufficient, a gas-liquid mixture fluid flows into the water flow pipe 4. If the gas-liquid mixture fluid flows into the water flow pipe 4, the specific gravity of the fluid in a pipe path 4A (not shown) on the inflow side thereof is reduced by the included gas, so that the water supply effect of the pressure difference between the fluid in the pipe path 4A and the fluid in a pipe path 4C (not shown) on the outflow side (the difference between the heads) cannot be sufficiently be exhibited.

As a result, the gas-liquid mixture fluid fills the upstream vacuum sewer 2 at the branching portion 2A of the air pipe 5 to flow into the air pipe 5.

The gas-liquid mixture fluid which has flowed into the air pipe 5 cannot rise through the air pipe 5 to stay therein, because the head from the lowermost-level portion of the air pipe 5 passing under the river 1 to the rising portion 5B is high. By this staying of the fluid including sewage water, the interior of the air pipe 5 is contaminated and it is possible that the air pipe 5 will be clogged.

To solve this problem, the method of setting a sufficiently long straight-line section in the upstream vacuum sewer 2 upstream of the branching portion 2A to enable gas-liquid separation in the flow through this section is adopted for the siphon culvert of FIG. 1.

However, setting a sufficiently long straight-line section is not preferable, because design restrictions are thereby imposed with respect to the connection of branching pipe, setting heads and so on.

In the siphon culverts of FIGS. 2 and 18, the pit 7 serving as a gas-liquid separator is provided in the upstream vacuum sewer 2, as described above, so that water having no or substantially no bubbles flows into the water flow pipe 4, thereby enabling water to flow constantly smoothly.

In the embodiments of FIGS. 2 and 18, solid matters which can deposit easily, among solid matters in the sewage water flowing out of the upstream vacuum sewer 2, deposits in the pit 7, so that the amount of deposits in the water flow pipe 4 is very small. Therefore, it is sufficient to perform blowing-out at a low frequency. Deposits accumulated in the pit 7 may be discharged as desired by removing the cover 8.

Figure 6:
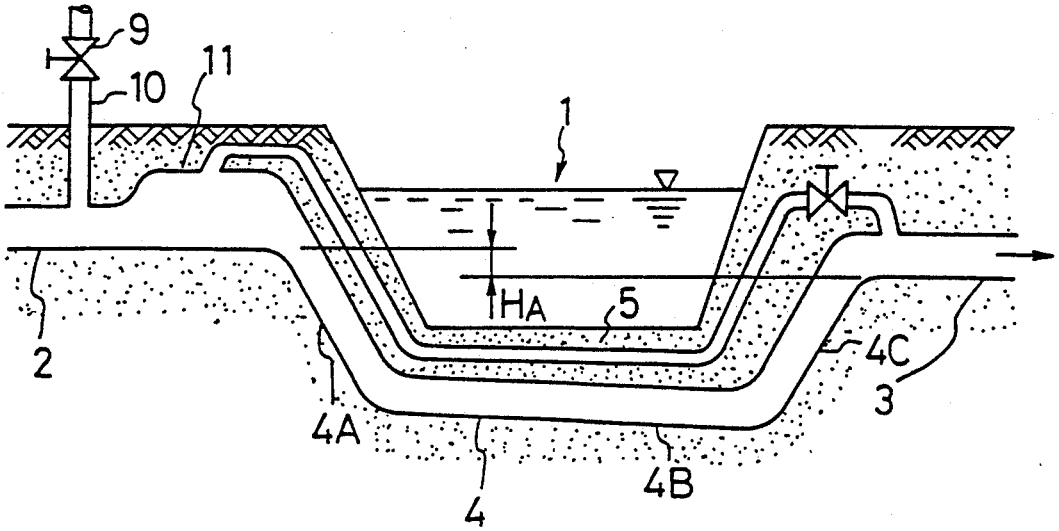
FIG. 6 is a cross-sectional view of another embodiment of the vacuum sewerage in the second form.
Figure 19:
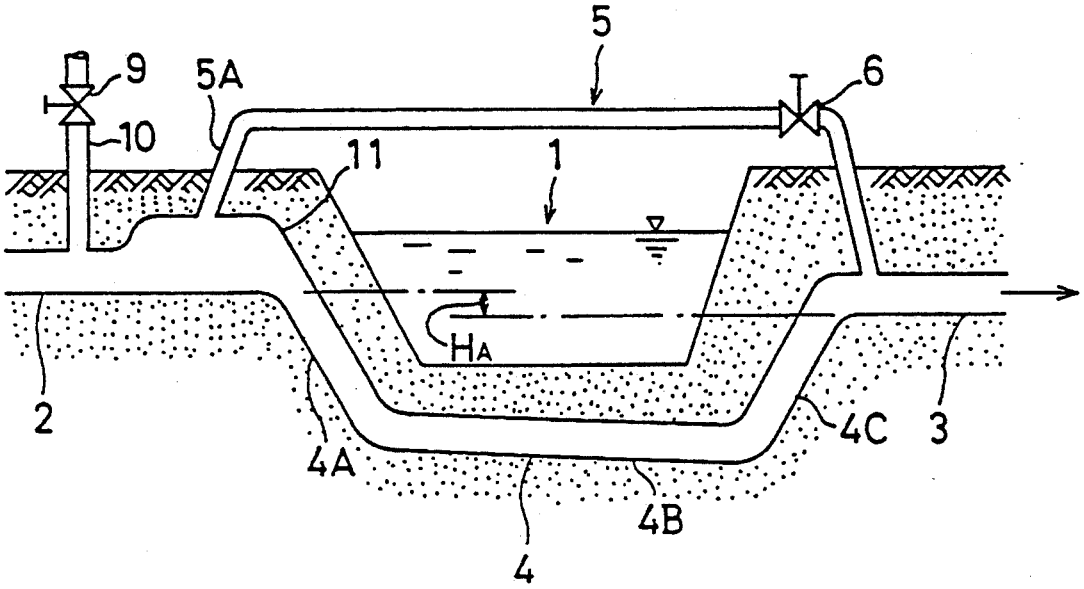
FIG. 19 is a cross-sectional view of another embodiment of the vacuum sewerage in the second form.

FIGS. 6 and 19 show other embodiments of the vacuum sewerage siphon culvert according to the second form. The vacuum sewerage siphon culvert shown in FIG. 6 is the same as that shown in FIG. 2 except that a gas-liquid separator 11 is provided in a branching portion of the air pipe 5 of the upstream vacuum sewer 2. Components having the same functions are indicated by the same reference characters.

In the vacuum sewerage siphon culvert of this embodiment, the gas-liquid separator 11 is constructed by increasing the pipe diameter of a corresponding portion of the upstream vacuum sewer 2 so as to form a portion having large sectional path area.

In the embodiment of FIG. 19, the air pipe 5 is laid so as to pass over the river 1. The construction of this embodiment is the same as that of FIG. 6 in other respects.

In this embodiment, the fluid which has flowed from the upstream vacuum sewer 2 is efficiently separated into a gas and a liquid in the gas-liquid separator 11, and the gas, i.e., air or the like flows separately to the air pipe 5 and the sewage water flows to the water flow pipe 4, so that water passes smoothly through the water flow pipe 4.

Figure 7:
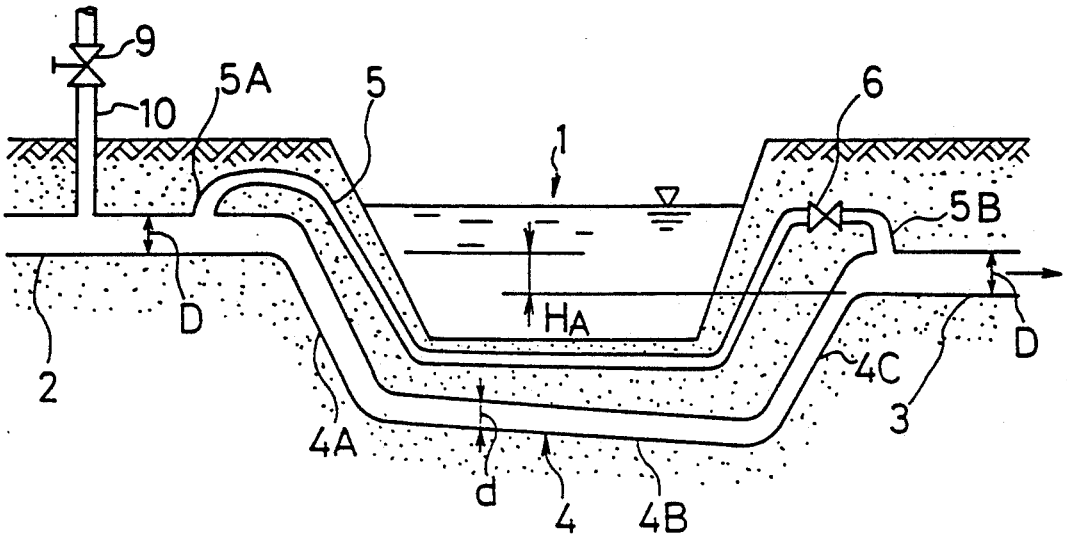
FIG. 7 is a cross-sectional view of an embodiment of the vacuum sewerage in the third form.
Figure 20:
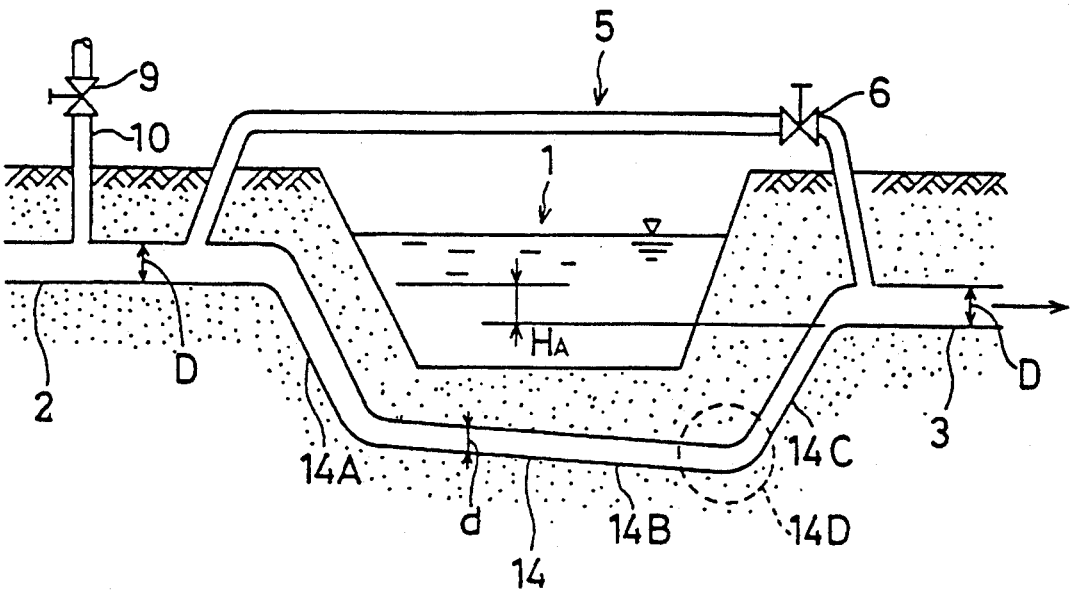
FIG. 20 is a cross-sectional view of an embodiment of the vacuum sewerage in the third form.

FIGS. 7 and 20 are cross-sectional views of vacuum sewerage siphon culverts in accordance with embodiments in the third form.

In these embodiments, the diameter d of the entire water flow pipe 4 is set to be smaller than the diameter D of the upstream vacuum sewer 2 ($d<D$), so that the sectional path area of a falling-gradient pipe path 4A, a path 14B which is generally horizontal but has a sight falling gradient and a rising-gradient pipe path 4C is smaller than the sectional path area of the upstream vacuum sewer 2. In this embodiment, the diameter of the downstream vacuum sewer 3 and the diameter of the upstream vacuum sewer 2 are set to equal values. Thus, the diameter of the water flow pipe 4 is reduced, so that the water flow velocity in the water flow pipe 4 is high. Accordingly, depositions of solid matters in the water flow pipe 4 can be prevented.

In the embodiment of FIG. 20, the air pipe 5 is laid so as to pass over the river 1, and the construction is the same as that of FIG. 7 in other respects.

In the embodiments of FIGS. 7 and 20, the diameter of the water flow pipe 4 is reduced through the entire length thereof in comparison with the diameter of the upstream vacuum sewer. In accordance with the present invention, however, only the sectional path area of the portion at which the water flow pipes 4B and 4C meet, where extraneous matters can be deposited most easily, may be set to be smaller than that of the upstream vacuum sewer. Accordingly, for example, the diameter of the pipe path 4A may be made equal to the diameter of the upstream vacuum sewer while the diameter of the pipe paths 4B and 4C alone is made smaller than the diameter of the upstream vacuum sewer.

The rate at which the sectional path area of the water flow pipe is reduced with respect to the sectional path area of the upstream vacuum sewer is determined according to the installation place configuration, the scale and sewage conditions and the like. Ordinarily, a preferred design is such that a flow velocity of 0.6 to 0.8 m/sec or higher can be obtained at the portion where the sectional path area is reduced.

Figure 8:
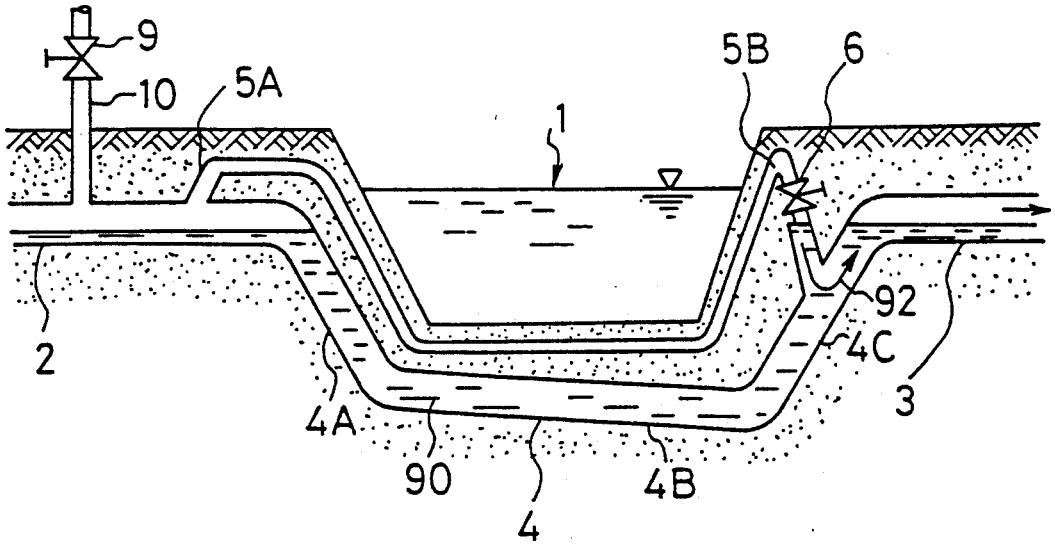
FIG. 8 is a cross-sectional view of an embodiment of the vacuum sewerage in the fourth form.
Figure 21:
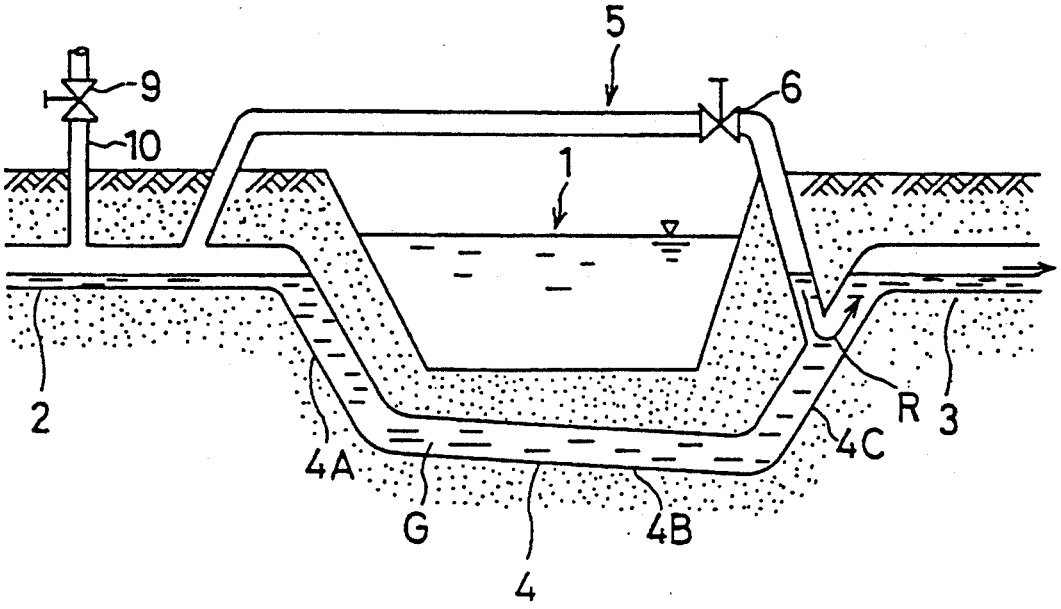
FIG. 21 is a cross-sectional view of an embodiment of the vacuum sewerage in the fourth form.

FIGS. 8 and 21 are cross-sectional views of vacuum sewerage siphon culverts in accordance with embodiments in the fourth form.

In these embodiments, the downstream end of the air pipe 5 is connected to an intermediate portion of a section 4C of the water flow pipe 4 having a rising gradient toward the downstream vacuum sewer 3.

In the embodiment of FIG. 21, the air pipe 5 is laid so as to pass over the river 1, and the construction is the same as that of FIG. 8 in other respects.

In these embodiments, during ordinary operation, the valve 6 is also open while the valve 9 is closed. Sewage water 90 which has flowed through the upstream vacuum sewer 2 passes through the water flow pipe 4, reaches the downstream vacuum sewer 3 and flow further downstream through the downstream vacuum sewer 3. On the other hand, the vacuum in the downstream vacuum sewer 3 is transmitted to the upstream vacuum sewer 2 through the air pipe 5 to effect air lifting with respect to a head (not shown) provided in the upstream vacuum sewer 2.

At this time, in the section of the water flow pipe 4 from the air pipe 5 connection position to the downstream vacuum sewer 3, a pumping-up action in the direction of arrow 92 is caused by an air-lift effect based on drawing from the downstream vacuum sewer 3 by the negative pressure transmitted through the air pipe 5. Therefore, even if the position of the downstream vacuum sewer 3 is higher than the conventional design position, sewage water can be efficiently caused to flow.

To maintain a head necessary for causing sewage water to flow through the water flow pipe 4 from the upstream vacuum sewer 2 toward the downstream vacuum sewer 3 in the vacuum sewerage siphon culverts shown in FIGS. 1, 17, 2, 18, 6, 19, 7, and 20, it is necessary to lay the upstream vacuum sewer 2 always at a level higher than that of the downstream vacuum sewer 3 by $H_A$, as mentioned above. In other words, it is necessary to lay the downstream vacuum sewer 3 always at a level lower than that of the upstream vacuum sewer 2 by $H_A$. Accordingly, if an obstacle such as a culvert exists in the planned laying place for the down stream vacuum sewer, and if it is impossible to lay the downstream vacuum sewer at a low-level position at which this difference $H_A$ in level can be set, the vacuum sewerage siphon culverts of FIGS. 1, 2, 6, and 7 cannot be applied.

In contrast, in the embodiments of FIGS. 8 and 21, in the section of the water flow pipe 4 from the air pipe 5 connection position to the downstream vacuum sewer 3, a pumping-up action in the direction of arrow 92 is caused by the air-lift effect based on drawings from the downstream vacuum sewer 3, as described above. It is therefore possible to efficiently cause sewage water to flow even if the position of the downstream vacuum sewer 3 is higher than the conventional design position. Consequently, it is possible to increase the degree of sewer design freedom by setting a slight allowable range of the level at which the downstream vacuum sewer is laid.

In the embodiments of FIGS. 8 and 21, the position at which the air pipe is connected to the water flow pipe is determined as desired according to the difference between the levels of the upstream and downstream vacuum sewers and other factors.

Figure 9:
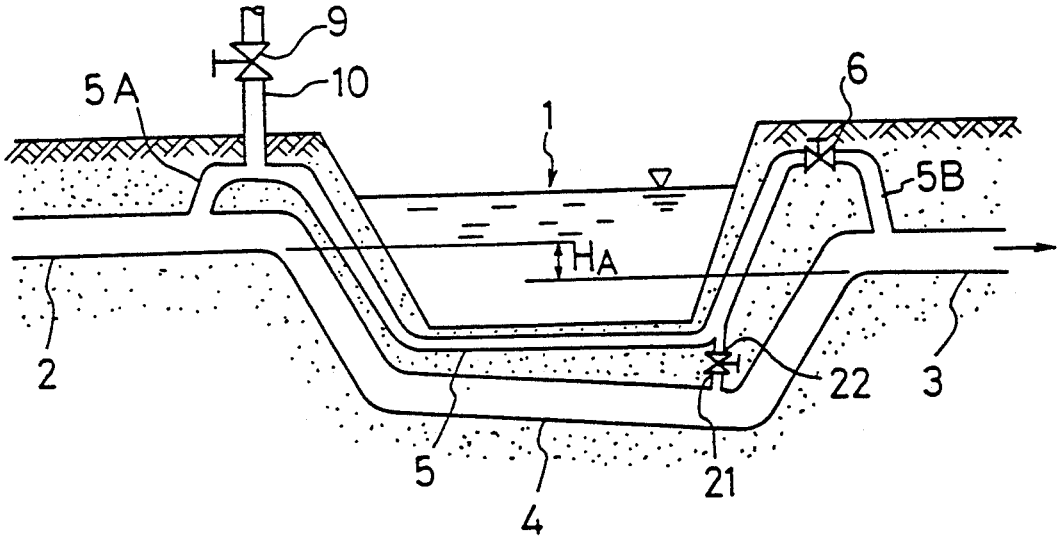
FIG. 9 is a cross-sectional view of an embodiment of the vacuum sewerage in the fifth form.
Figure 22:
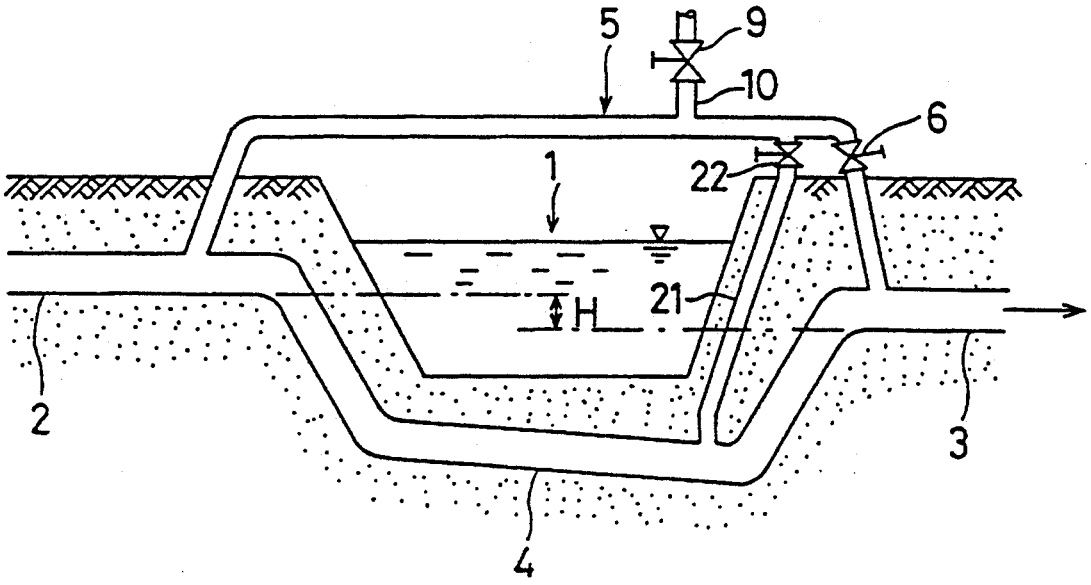
FIG. 22 is a cross-sectional view of an embodiment of the vacuum sewerage in the fifth form.

FIGS. 9 and 22 are cross-sectional views of vacuum sewerage siphon culverts in accordance with embodiments in the fifth form. These embodiments differ from those of FIGS. 1 and 17 in that a communication pipe 21 is provided which connects the air pipe 5 and a portion of the water flow pipe 4 in the vicinity of the lowermost-level portion thereof, and that a valve 22 is provided in this communication pipe.

In the embodiment of FIG. 22, the air pipe 5 is laid so as to pass over the river 1, and the construction is the same as that of FIG. 9 in other respects.

In the thus-constructed vacuum sewerage siphon culverts, during ordinary operation, the valve 6 is open while the valve 9 and the valve 22 are closed. Sewage water which has flowed through the upstream vacuum sewer 2 passes through the water flow pipe 4, reaches the downstream vacuum sewer 3 and flows further downstream through the downstream vacuum sewer 3.

On the other hand, the vacuum in the downstream vacuum sewer 3 is transmitted to the upstream vacuum sewer 2 through the air pipe 5 to effect air lifting with respect to a head (not shown) provided in the upstream vacuum sewer 2.

If deposits are accumulated in the water flow pipe 4 as sewage water flows, they are discharged as described below. That is, in the night time or in a holiday or the like when the amount of downflow water is small, the valve 6 is closed and the valves 9 and 22 are opened to draw air to the lowermost-level portion of the water flow pipe 4 and to reduce the pressure in the downstream vacuum sewer 3 by the vacuum station. The deposits accumulated in the lowermost-level portion of the water flow pipe 4 are directly blown with air to be loosened and is forced by a large amount of sewage water in the water flow pipe 4 to be rapidly discharged to the downstream vacuum sewer 3. Instead of air blowing, pressure-introduction using an air pump or the like may be performed.

Figure 11:
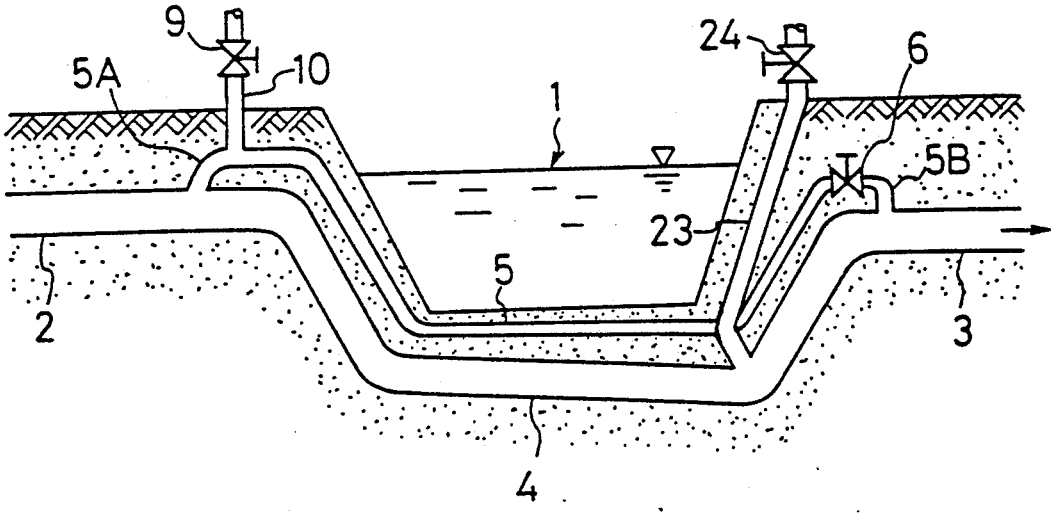
FIG. 11 is a cross-sectional view of an embodiment of the vacuum sewerage in the fifth form.
Figure 24:
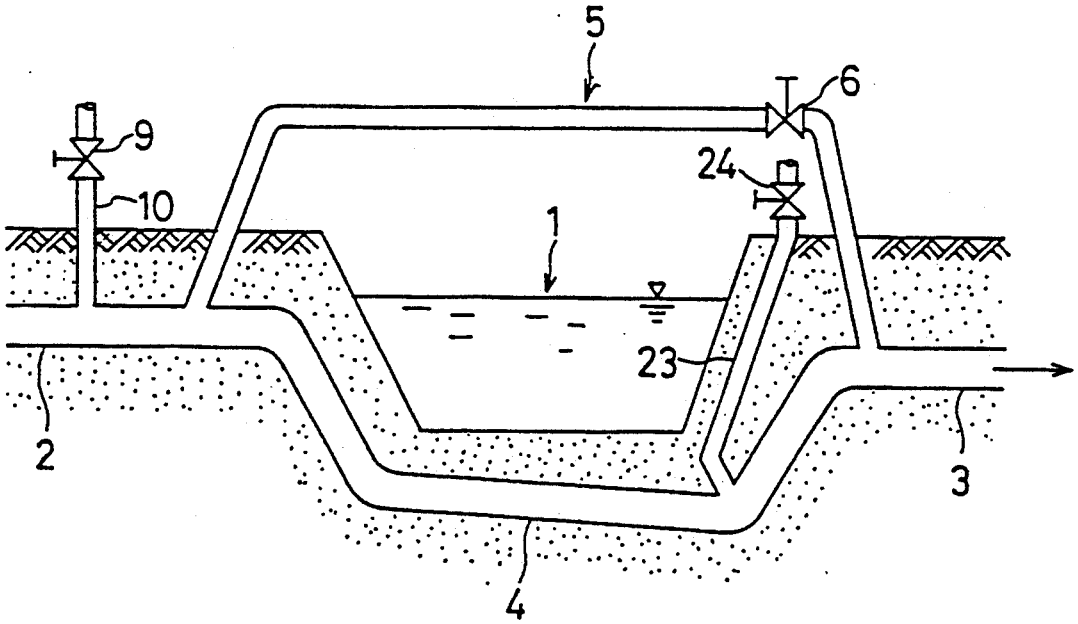
FIG. 24 is a cross-sectional view of an embodiment of the vacuum sewerage in the fifth form.

The pipe path for enabling the lowermost-level portion of the water flow pipe or a portion of the water flow pipe in the vicinity of the lowermost-level portion to communicate with the atmospheric air in the vacuum sewerage siphon culvert in the fifth form is not limited to a pipe path for providing a communication via the air pipe as shown in FIGS. 9 and 22, and, alternatively, it may comprise a communication pipe 23 and a valve 24 for providing a direct communication with the atmospheric air as shown in FIGS. 11 and 24.

In the vacuum sewerage siphon culverts of FIGS. 11 and 24, during ordinary operation, the valve 6 is also open while the valve 24 is closed. At the time of air blowing, the valve 6 is closed and the valve 24 is opened, thereby discharging deposits efficiently.

Figure 12A:
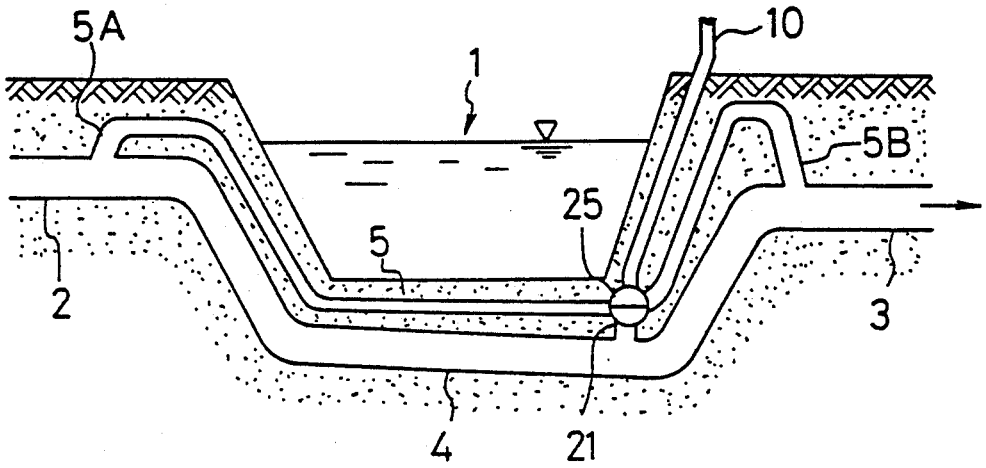
FIG. 12A is a cross-sectional view of an embodiment of the vacuum sewerage in the fifth form.
Figure 12B:
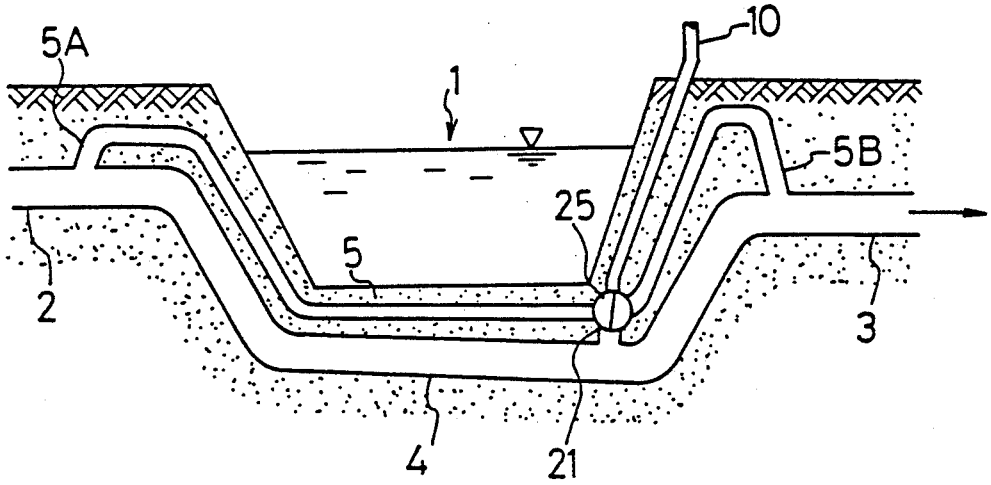
FIG. 12B is a cross-sectional view of an embodiment of the vacuum sewerage in the fifth form.
Figure 25A:
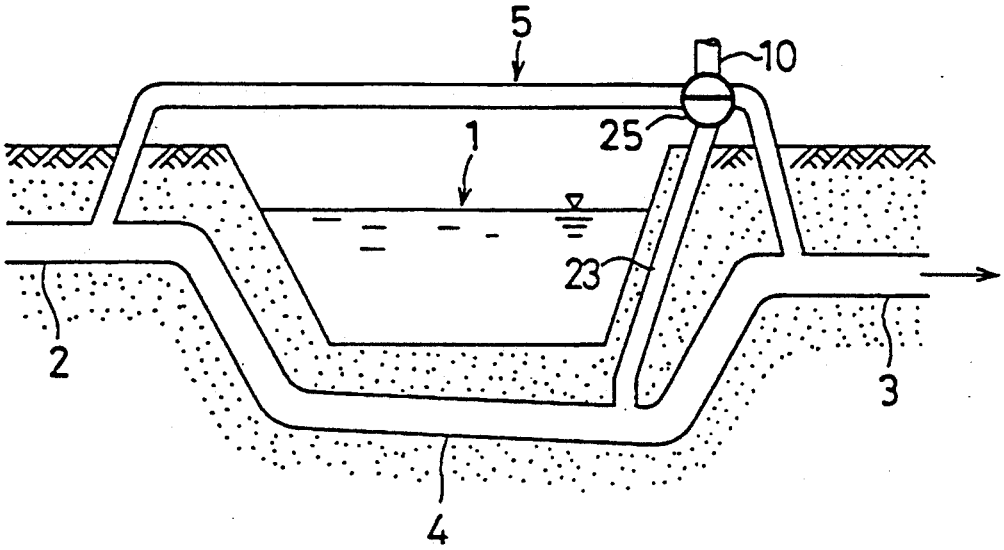
FIG. 25A is a cross-sectional view of an embodiment of the vacuum sewerage in the fifth form.
Figure 25B:
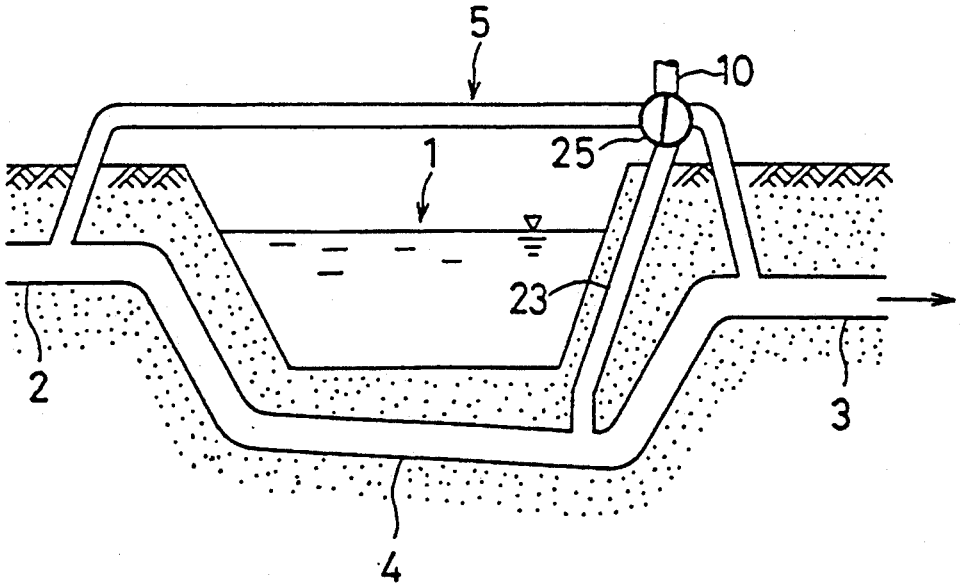
FIG. 25B is a cross-sectional view of an embodiment of the vacuum sewerage in the fifth form.
Figure 26A:
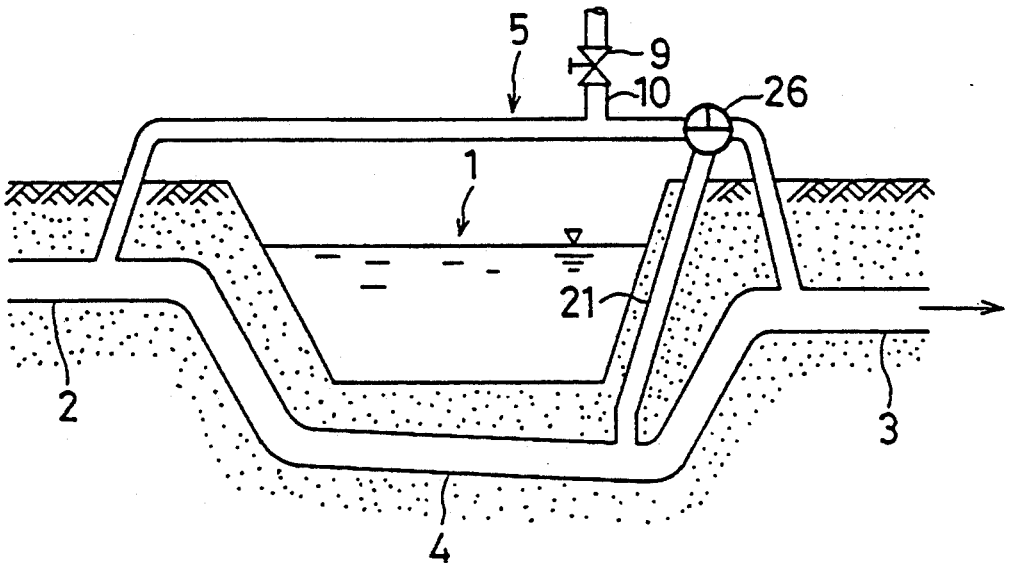
FIG. 26A is a cross-sectional view of an embodiment of the vacuum sewerage in the fifth form.
Figure 26B:
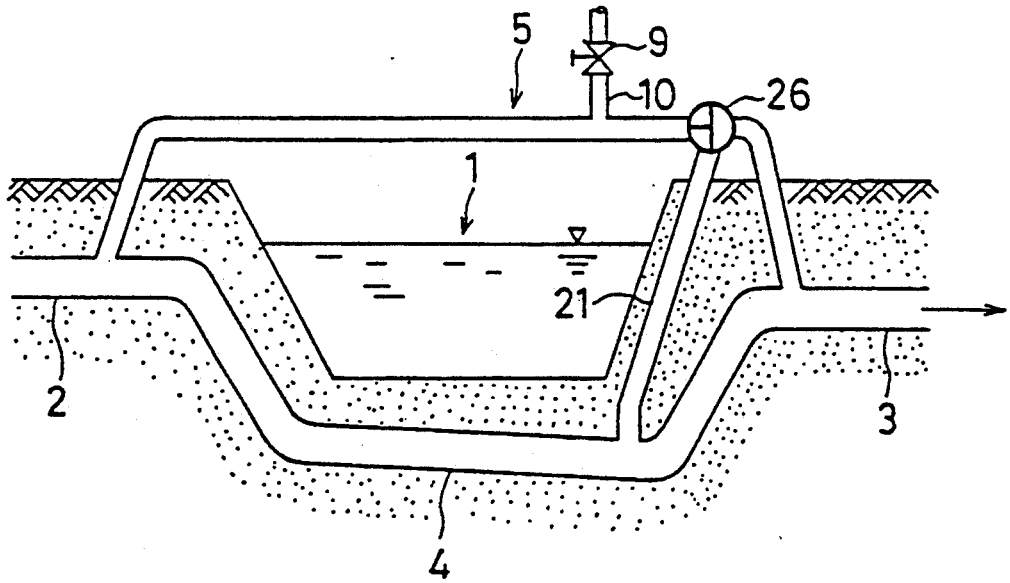
FIG. 26B is a cross-sectional view of an embodiment of the vacuum sewerage in the fifth form.

Also, the arrangement may be such that, as shown in FIGS. 12A, 12B, 25A, and 25B, a communication pipe 21 or 23, an atmosphere communication pipe 10 and an air pipe 5 are connected by a four-way valve 25, and the four-way valve 25 is changed with respect to the ordinary state (FIG. 12A, FIG. 25A) and the air blowing state (FIG. 12B, FIG. 25B).

Figure 13A:
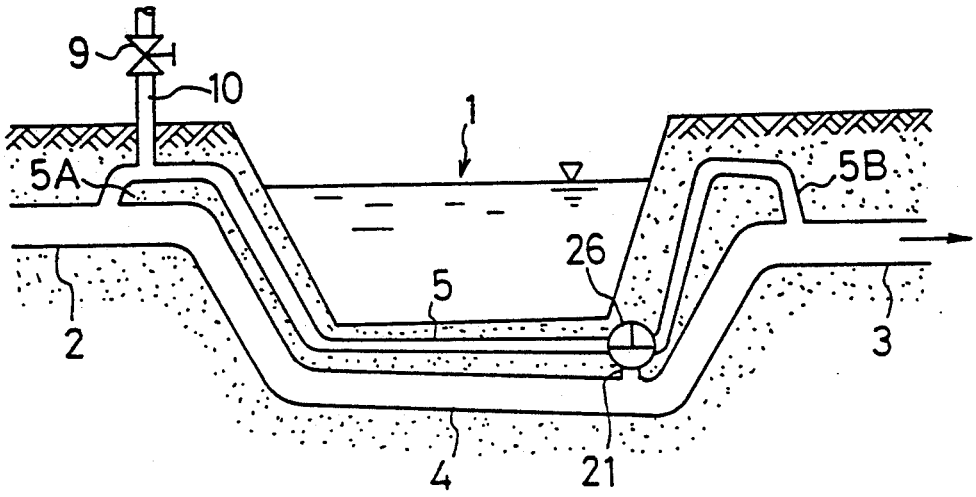
FIG. 13A is a cross-sectional view of an embodiment of the vacuum sewerage in the fifth form.
Figure 13B:
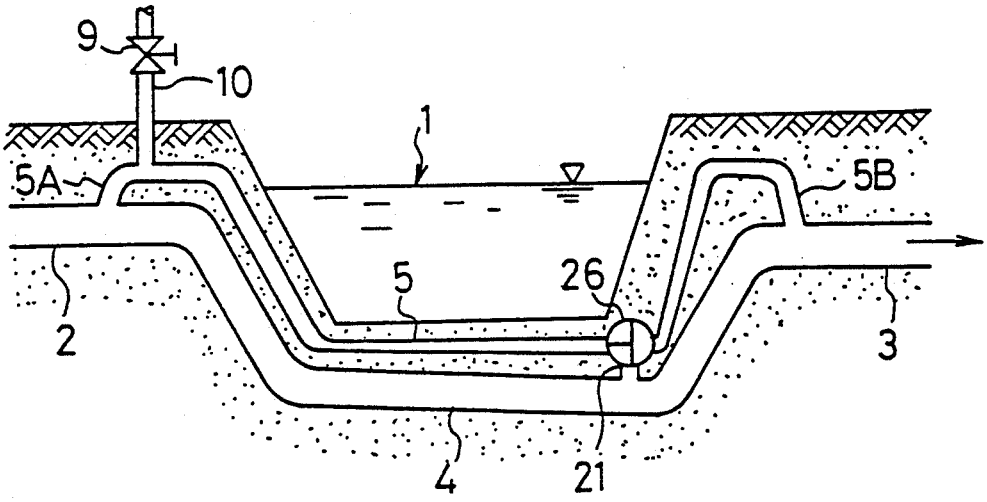
FIG. 13B is a cross-sectional view of an embodiment of the vacuum sewerage in the fifth form.

Further, the arrangement may be such that, in the vacuum sewerage siphon culverts shown in FIGS. 9 and 22, a three-way valve 26 is provided at the connection between the communication pipe 21 and the air pipe 5 instead of the valves 6 and 22, as shown in FIGS. 13A and 13B, and the three-way valve 26 is changed with respect to the ordinary state (FIG. 13A) and the air blowing state (FIG. 13B).

Vacuum sewerage siphon culverts in the sixth form are constructed based on such vacuum sewerage siphon culverts in the fifth form in such a manner that a second pipe path is further provided to enable an intermediate portion of the section of the water flow pipe having a rising gradient in the downstream direction to communicate with the atmospheric air.

Figure 14:
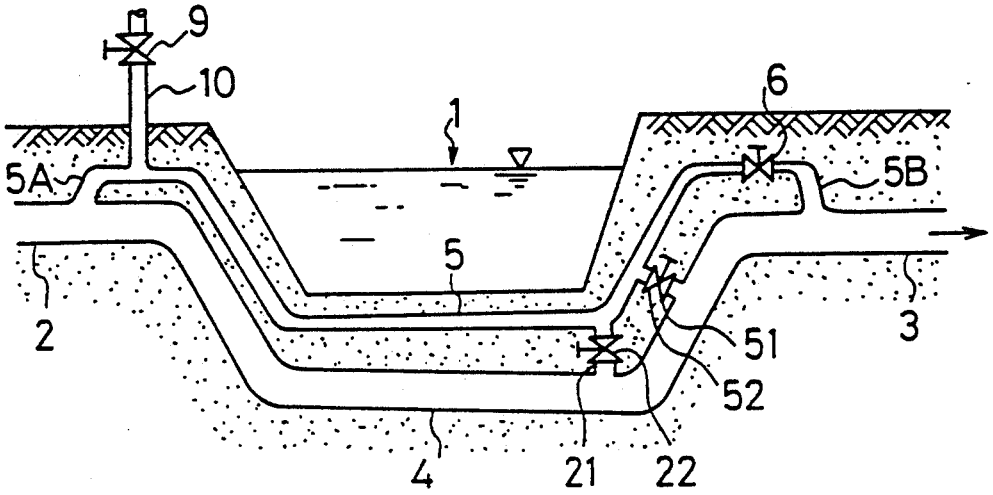
FIG. 14 is a cross-sectional view of an embodiment of the vacuum sewerage in the sixth form.
Figure 27:
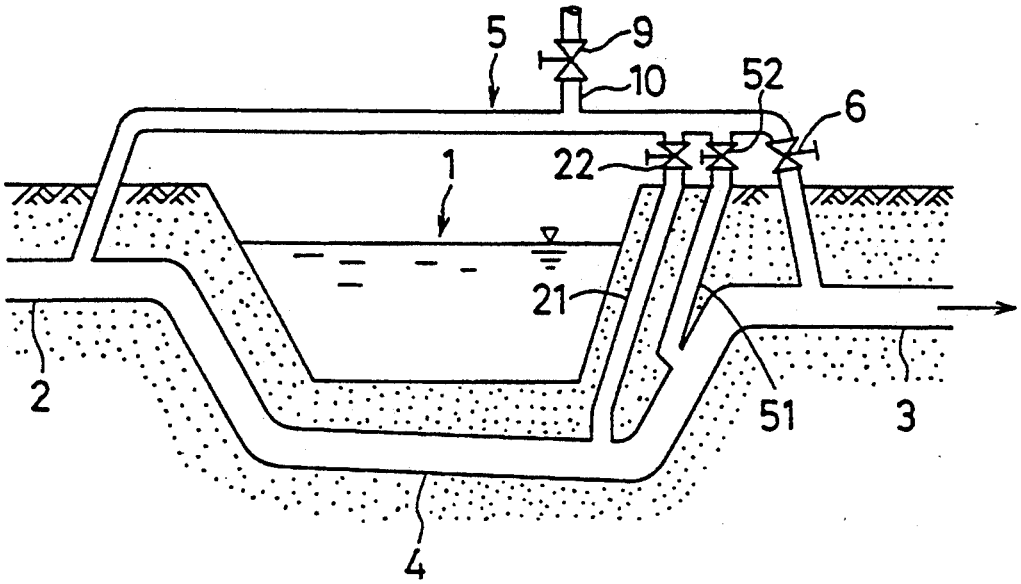
FIG. 27 is a cross-sectional view of an embodiment of the vacuum sewerage in the sixth form.

Vacuum sewerage siphon culverts shown in FIGS. 14 and 27 are constructed by further providing the vacuum sewerage siphon culverts of FIGS. 9 and 22 with a communication pipe 51 for communication between an intermediate position on the rising gradient portion of the water flow pipe 4 and the air pipe 5, and a valve 52 in this communication pipe 51.

In this vacuum sewerage siphon culvert, during ordinary operation, the valve 6 is open while the valves 9, 22, and 52 are closed. At the time of air blowing, the valves 9 and 52 are first opened and the valves 6 and 22 are then closed to effect primary blowing. In this case, pumping with a small degree of initial decompression is possible. After the completion of the primary blowing, the valve 52 is closed and the valve 22 is opened while the valve 6 is closed and the valve 9 is open, thereby effecting secondary blowing. With respect to the secondary blowing as well, pumping with a small degree of initial decompression is possible. It is thereby possible to easily perform air blowing even in a vacuum sewerage siphon culvert having a low degree of vacuum in the system.

The reason for the reduction in the necessary degree of decompression at the start of air blowing in the siphon culverts of the embodiments of FIGS. 14 and 27 (the embodiments in the sixth form) is described with reference to FIGS. 1, 9, 10, 17, 22, and 23 for comparison. For ease of description, it is assumed that the specific gravity of sewage water is 1, the specific gravity of air is 0, and sewage water and air are mixed at a ratio of 1:1 to form a gas-liquid mixture phase fluid having a specific gravity of 0.5 by air blowing.

Figure 10:
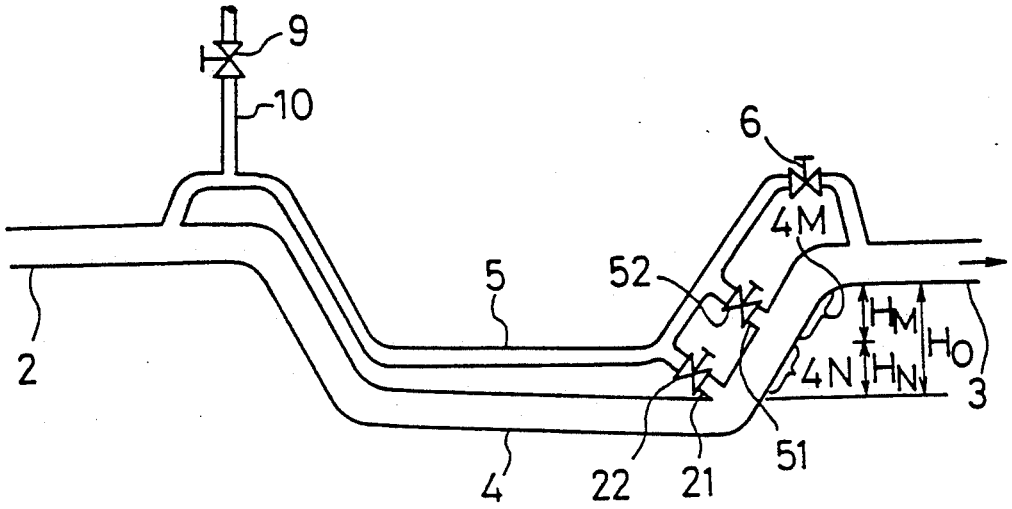
FIG. 10 is a diagram of a pipe line arrangement of an embodiment of the vacuum sewerage in the sixth form.
Figure 23:
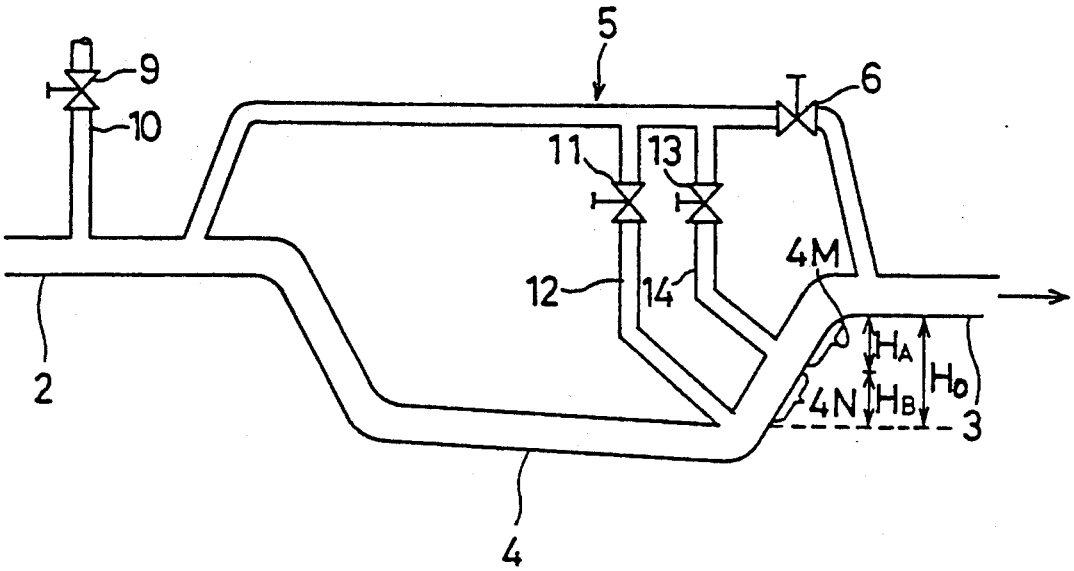
FIG. 23 is a diagram of a pipe line arrangement of an embodiment of the vacuum sewerage in the sixth form.

FIG. 10 is a diagram of the pipe path arrangement of the siphon culvert of FIG. 14, and FIG. 23 is a diagram of the pipe path arrangement of the siphon culvert of FIG. 27.

(1) In the case of the siphon culvert in the first form

In the vacuum sewerage siphon culverts in the first form shown in FIGS. 1 and 17, the decompression required at the start of air blowing (hereinafter referred to as "the degree of initial decompression" in some cases) performed by closing the valve 6 and opening the valve 9 is the difference between the levels of the water flow pipe 4 and the downstream vacuum sewer 3 referred to $H_0$ in FIGS. 10 and 23.

(2) In the case of the siphon culvert in the fifth form of FIGS. 9 and 22

In the vacuum sewerage siphon culverts in the fifth form shown in FIGS. 9 and 22, the degree of initial decompression for air blowing performed by closing the valve 6 and opening the valves 9 and 22 is equal to the difference $H_0$ between the levels of a communication pipe 21 connection portion and the downstream vacuum sewer 3. While air blowing is thereafter continued, the necessary degree of decompression (hereinafter referred to as "the degree of continued decompression" in some case) is $\frac{1}{2} H_0$ since a mixture fluid, i.e., a 1:1 mixture of sewage water and air is drawn.

(3) In the case of the siphon culvert in the sixth form of FIGS. 10 and 23

In the vacuum sewerage siphon culverts in the sixth form shown in FIGS. 10 and 23, air blowing in a portion 4M of the water flow pipe 4 having a level higher than that of a communication pipe 14 connection portion through the atmosphere communication pipe 10, the air pipe 5 and the communication pipe 51 is performed by closing the valve 6, opening the valves 9 and 52 and closing the valve 22 to start air blowing (which air blowing hereinafter referred to as "primary blowing" in some case). In this case, the degree of initial decompression necessary for starting this primary blowing is $H_M$, and the degree of continued decompression is $\frac{1}{2} H_M$.

Next, in the case of air blowing by closing the valve 52, opening the valve 22 and maintaining the valve 6 in the closed state and the valve 9 in the open state while the fluid in the portion 4M of the water flow pipe 4 having a level higher than that of a communication pipe 52 connection portion is changed into a gas-liquid mixture phase fluid by the primary blowing (which air blowing hereinafter referred to as "secondary blowing" in some case), the degree of initial decompression necessary for this secondary blowing is equal to the sum ($\frac{1}{2}$ $H_M+H_N$) of the degree of continued decompression $\frac{1}{2}$ $H_M$ and $H_N$ corresponding to the amount of sewage water in a portion 4N having a lever lower than that of a communication pipe 51 connection portion. Thereafter, the degree of continued decompression is $\frac{1}{2}$ $H_0$, as described above.

Thus, while the necessary degree of initial decompression for air blowing is equal to the degree of initial decompression $H_0$ in the case of the vacuum sewerage siphon culverts of FIGS. 1, 9, 17 and,22, it is $\frac{1}{2}$ $H_M+H_N$ in the case of the vacuum sewerage siphon culvert in the sixth form, that is a pressure smaller by $\frac{1}{2}$ $H_M$ than that required for the siphon culverts of FIGS. 1, 9, 17, and 22 will suffice.

In a case where secondary air blowing is performed after the water in the portion 4M has been entirely discharged by primary blowing, the degree of initial decompression for the secondary blowing is only $H_N$.

Thus, in the vacuum sewerage siphon culvert in the sixth form, the degree of decompression required at the start of blowing is greatly reduced, so that air blowing can be performed efficiently even when the degree of vacuum in the vacuum sewer is insufficient.

Figure 15:
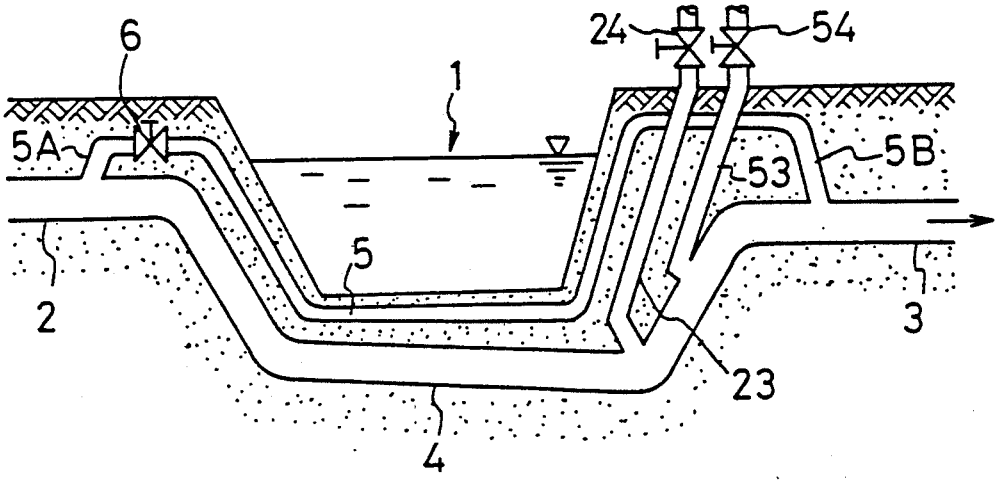
FIG. 15 is a cross-sectional view of an embodiment of the vacuum sewerage in the sixth form.
Figure 28:
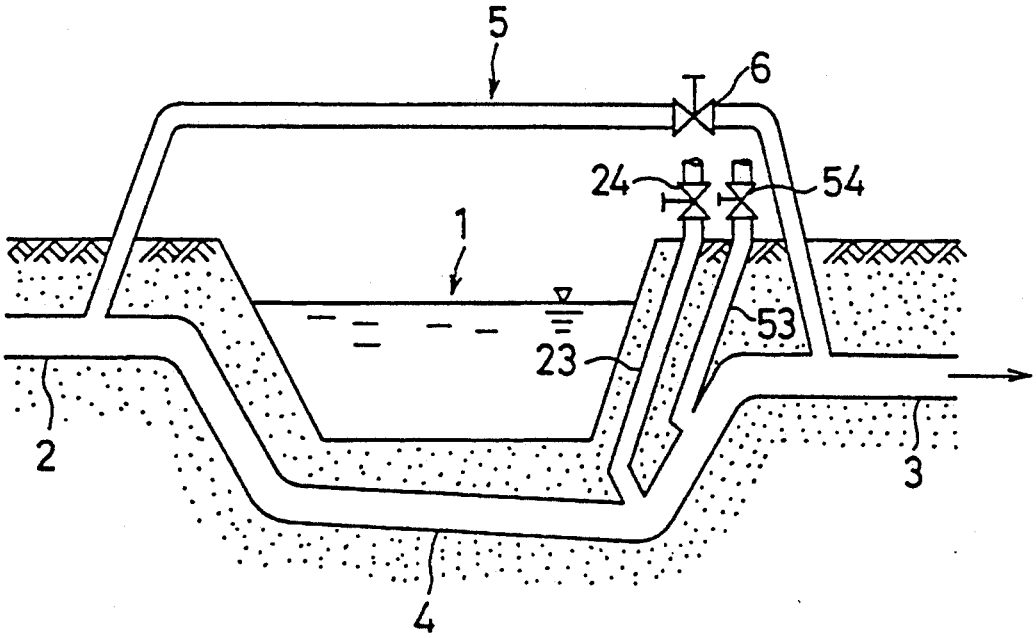
FIG. 28 is a cross-sectional view of an embodiment of the vacuum sewerage in the sixth form.

Vacuum sewerage siphon culverts shown in FIGS. 15 and 28 are arranged in accordance with the sixth form by further providing a communication pipe 53 with a valve 54 in the vacuum sewerage siphon culverts shown in FIGS. 11 and 24.

In the vacuum sewerage siphon culverts of FIGS. 15 and 28, during ordinary operation, the valve 6 is also open while the valves 24, and 54 are closed. At the time of air blowing, the valve 54 is opened and the valves 6 and 24 are closed to perform primary blowing. After the completion of the primary blowing, the valve 54 is closed and the valve 24 is opened while the valve 6 is in the closed state, thereby performing secondary blowing.

In the case of the vacuum sewerage siphon culverts in the sixth form shown in FIGS. 14, 27, 15, and 28, as well, the air blowing operation can also be performed by using the same four-way valve or a three-way valve as that shown in FIGS. 12A, 12B, 13A and 13B.

Figure 16A:
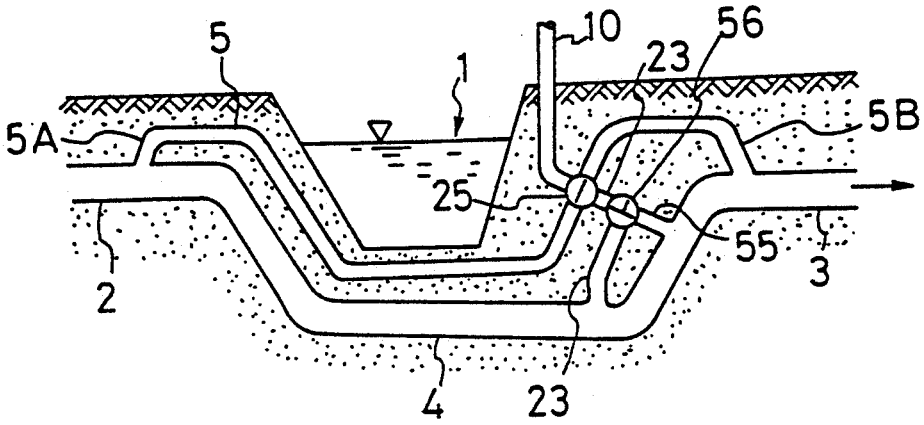
FIG. 16A is a cross-sectional view of an embodiment of the vacuum sewerage in the sixth form.
Figure 16B:
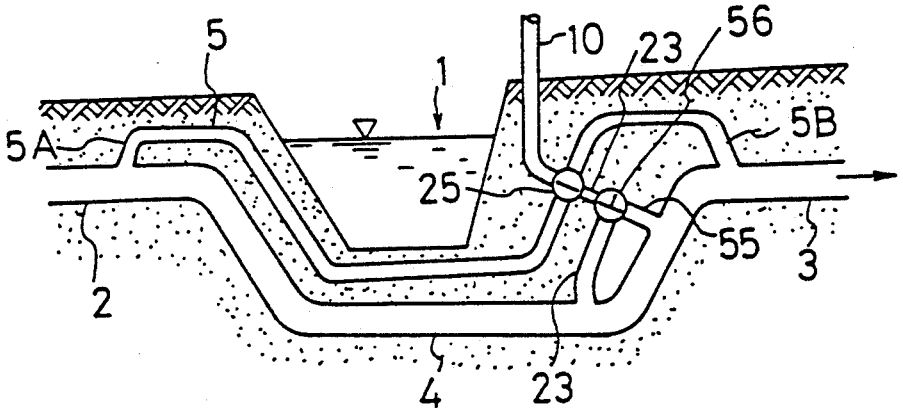
FIG. 16B is a cross-sectional view of an embodiment of the vacuum sewerage in the sixth form.
Figure 16C:
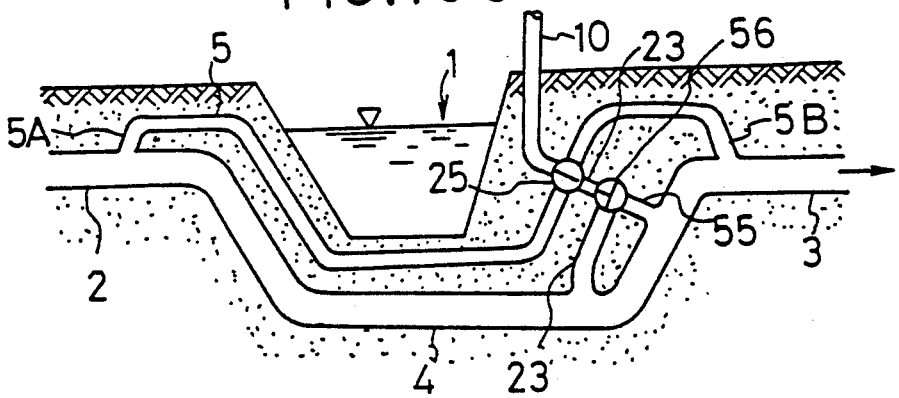
FIG. 16C is a cross-sectional view of an embodiment of the vacuum sewerage in the sixth form.
Figure 29A:
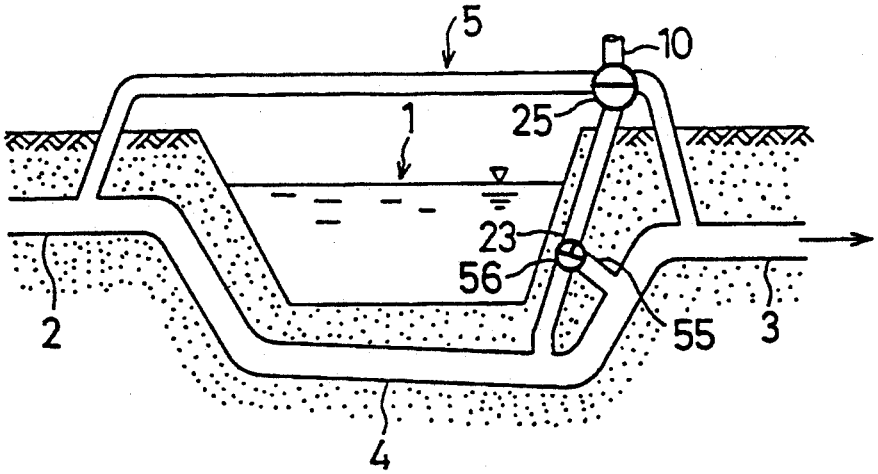
FIG. 29A is a cross-sectional view of an embodiment of the vacuum sewerage in the sixth form.
Figure 29B:
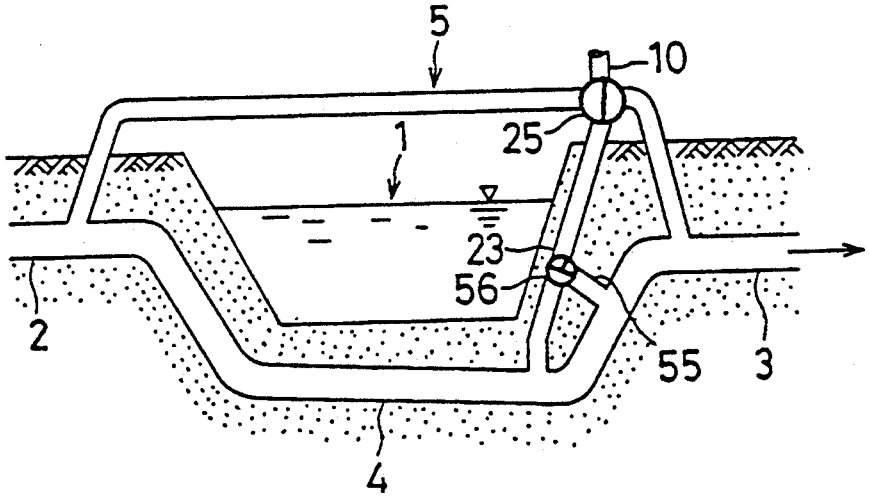
FIG. 29B is a cross-sectional view of an embodiment of the vacuum sewerage in the sixth form.
Figure 29C:
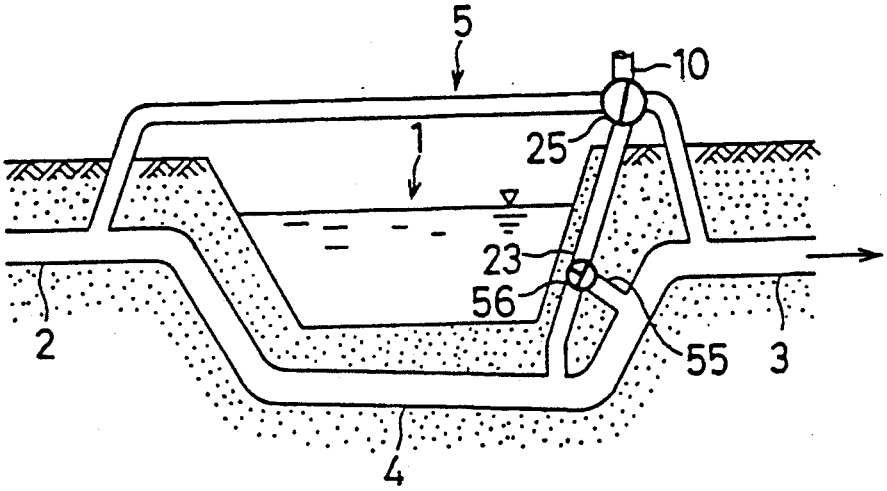
FIG. 29C is a cross-sectional view of an embodiment of the vacuum sewerage in the sixth form.

FIGS. 16A and 29A show arrangements in which a three-way valve 56 is provided in an intermediate portion of the communication pipe 23 of the vacuum sewerage siphon culverts shown in FIGS. 12A and 25A, and a communication pipe 55 which branches from the three-way valve 56 is connected to an intermediate portion of the rising gradient section of the water flow pipe 4. The four-way valve 25 and the three-way valve 56 are changed with respect to the ordinary state (FIG. 16A, FIG. 29A), the primary blowing state (FIG. 16B, FIG. 29B) and the secondary blowing state (FIG. 16C, FIG. 29C).

In each of the above-described embodiments, the obstacle is a river. However, according to the present invention, the obstacle may be a building having an underground foundation.

INDUSTRIAL APPLICABILITY

As described above in detail, in the vacuum sewerage siphon culvert in accordance with the present invention, even if the vacuum sewerage is constructed so as to extend across an obstacle such as a river, it is possible to effectively prevent a reduction in the vacuum generated by a vacuum station at a portion crossing the obstacle. It is therefore possible to greatly extend the area to which the vacuum sewage water collection system is applied and the sewage water transportable range of the vacuum sewage water collection system, i.e., a sewage water collection basin thereof. The degree of design freedom can also be increased. The utility of the invention in the industrial field if therefore high.

In the vacuum sewerage siphon culvert in accordance with the present invention, water can flow through the water flow pipe always smoothly.

In the vacuum sewerage siphon culvert in accordance with the present invention, accumulation of deposits in the water flow pipe can be prevented.

In the vacuum sewerage siphon culvert in accordance with the present invention, the downstream vacuum sewer can be laid at a higher level in comparison with the upstream vacuum sewer, so that the degree of freedom of designing the vacuum sewerage siphon culvert is greatly increased.

The vacuum sewerage siphon culvert in accordance with the present invention is capable of efficiently removing accumulated deposits.

What is claimed is:

1. A culvert of a vacuum sewerage in which an upstream vacuum sewer provided at one side of an obstacle and having a lower end, and a downstream vacuum sewer provided at the other side of the obstacle and having an upper end located lower than the lower end of the upstream vacuum sewer, are connected, said culvert comprising:

a water flow pipe passing under said obstacle to connect said upstream vacuum sewer and said downstream vacuum sewer; and an air pipe passing along one of upper and lower sides of said obstacle to connect said upstream vacuum sewer and said downstream vacuum sewer, said air pipe having end portions connected to the upstream and downstream vacuum sewers and disposed to orient at least partly upwardly from the sewers so that liquid inside the sewer does not enter into the air pipe to allow vacuum force in the downstream vacuum sewer to smoothly transfer to the upstream vacuum sewer without substantial vacuum loss in the water flow pipe flowing under the obstacle.

2. A culvert of a vacuum sewerage according to claim 1, further comprising gas-liquid separation means provided in said upstream vacuum sewer.

3. A culvert of a vacuum sewerage according to claim 1, wherein at least a lower portion of a section of said water flow pipe having a rising gradient in the downstream direction has a sectional path area smaller than that of said upstream vacuum sewer.

4. A culvert of a vacuum sewerage according to claim 1, wherein a downstream end of said air pipe is connected to a portion of said water flow pipe in the vicinity of said downstream vacuum sewer.

5. A culvert of a vacuum sewerage according to claim 1, further comprising:

a pipe path for enabling at least one of a lowermost-level portion of said water flow pipe and a portion in the vicinity of the lowermost-level portion to communicate with the atmospheric air; and flow path selection means for selectively establishing a first state in which said pipe path is opened to the atmospheric air and in which direct air flow from said air pipe into said downstream vacuum sewer is inhibited and a second state in which said pipe path is closed and in which direct air flow from said air pipe into said downstream vacuum sewer is allowed.

6. A culvert of a vacuum sewerage according to claim 1, further comprising:

a first pipe path for enabling at least one of a lowermost-level portion of said water flow pipe and a portion in the vicinity of the lowermost-level portion to communicate with the atmospheric air;

a second pipe path for enabling an intermediate portion of a section of said water flow pipe having a rising gradient in the downstream direction to communicate with the atmospheric air; and flow path selection means for selectively establishing a first state in which said first pipe path is opened to the atmospheric air while said second pipe path is closed and in which direct air flow from said air pipe into said downstream vacuum sewer is inhibited, a second state in which said first and second pipe paths are closed and in which direct air flow from said air pipe into said downstream vacuum sewer is allowed, and a third state in which said first pipe path is closed while said second pipe path is opened to the atmospheric air and in which direct air flow from said air pipe into said downstream vacuum sewer is inhibited.

7. A culvert of a vacuum sewerage according to claim 1, a valve for opening and closing said air pipe is provided in said air pipe, and means for introducing the atmospheric air to at least one of said air pipe and the upstream vacuum sewer is provided on upstream side of said valve.

8. A culvert for a vacuum sewerage system for crossing an obstacle, comprising:

an upstream vacuum sewer provided at one side of the obstacle and having a lower end near the obstacle, a downstream vacuum sewer provided at the other side of the obstacle and having an upper end near the obstacle, said upper end being located lower than the lower end of the upstream vacuum sewer, a water flow pipe passing under said obstacle and through a portion located lower than the upper end of the downstream vacuum sewer, said water flow pipe being connected between the lower end of the upstream vacuum sewer and the upper end of the downstream vacuum sewer; and an air pipe passing along one of upper and lower sides of said obstacle to connect said upstream vacuum sewer and said downstream vacuum sewer, said air pipe having front and rear end portions connected to the upstream and downstream vacuum sewers, respectively, said front and rear end portions orienting at least partly upwardly from the respective sewers so that liquid flowing inside the sewer flows only through the water flow pipe without entering into the air pipe to allow vacuum force in the downstream vacuum sewer to smoothly transfer to the upstream vacuum sewer without substantial vacuum loss in the water flow pipe flowing under the obstacle.

9. A culvert according to claim 8, wherein said air pipe further includes a valve for opening and closing the same, and said culvert further including means for introducing atmospheric air to at least one of said air pipe and said upstream vacuum sewer on an upstream side of the valve, said valve being opened and said means being closed in a normal usage, and said valve being closed and said means being opened for removing a material accumulated in the water flow pipe at vacuum pressure.

* * * * *